US007553138B2

(12) United States Patent
Gorban

(10) Patent No.: US 7,553,138 B2
(45) Date of Patent: Jun. 30, 2009

(54) ROTARY SCREW MACHINE OF VOLUME TYPE AND METHOD OF TRANSFORMING A MOTION IN A VOLUME SCREW MACHINE

(75) Inventor: Alexander Gorban, Kiev (UA)

(73) Assignee: Elthom Enterprises Limited, Nicosia (CY)

( * ) Notice: Subject to any disclaimer, the term of this patent is extended or adjusted under 35 U.S.C. 154(b) by 228 days.

(21) Appl. No.: 10/521,317

(22) PCT Filed: Jul. 14, 2003

(86) PCT No.: PCT/IB03/03266

§ 371 (c)(1),
(2), (4) Date: Sep. 8, 2005

(87) PCT Pub. No.: WO2004/007964

PCT Pub. Date: Jan. 22, 2004

(65) Prior Publication Data

US 2006/0127259 A1 Jun. 15, 2006

(30) Foreign Application Priority Data

Jul. 17, 2002 (EP) ..... 02291806

(51) Int. Cl.
*F01C 1/10* (2006.01)

(52) U.S. Cl. ..... 418/48; 418/61.1; 418/61.2; 418/61.3; 418/69; 418/59

(58) Field of Classification Search ..... 418/48, 418/61.1, 61.2, 69, 58, 59
See application file for complete search history.

(56) References Cited

U.S. PATENT DOCUMENTS 2,525,265 A * 10/1950 Moineau ..... 418/48
3,208,391 A * 9/1965 Lindberg ..... 418/48
3,299,822 A * 1/1967 Payne ..... 418/48
5,139,400 A * 8/1992 Ide ..... 418/48
5,439,359 A 8/1995 Leroy (Continued)

FOREIGN PATENT DOCUMENTS

EP 0 069 604 A 1/1983

(Continued)

*Primary Examiner*—Thomas E Denion
*Assistant Examiner*—Mary A Davis
(74) *Attorney, Agent, or Firm*—Connolly Bove Lodge & Hutz LLP; Myron Keith Wyche

(57) ABSTRACT

The invention relates to a rotary screw machine of volume type comprising a body (30) having a main axis X, two members (10, 20), wherein a first one (20) surrounds a second one (10). Said first member (20) is hinged in said body (30) and is able to swivel on itself about its axis (Xf), aligned with said main axis X, according to a swiveling motion, whereas the axis (Xm) of said second member (10), revolves about the axis of said first member (Xf) according to an revolution motion having said length E as a radius. The machine further comprises a synchronizer (34, 36, 38, 40) synchronizing said swiveling motion and said revolution motion, such that a working medium performs a volumetric displacement in at least one working chamber (11) delimited by an outer surface (22) of said first member (20) and a inner surface (12) of said second member (10).

16 Claims, 12 Drawing Sheets

Figure 1:
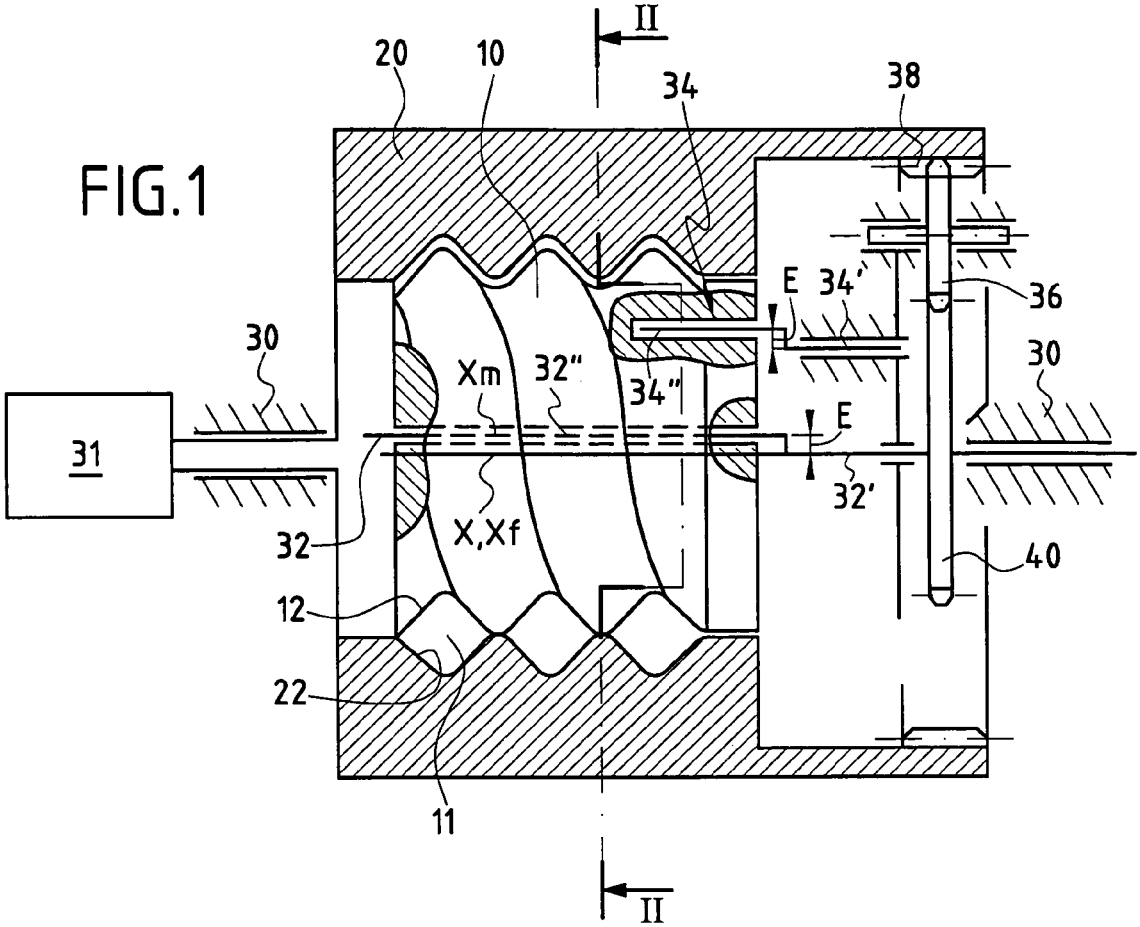

U.S. PATENT DOCUMENTS 6,093,004 A * 7/2000 Varadan et al. ..... 418/48
2006/0073059 A1* 4/2006 Beaudoin ..... 418/61.2
2006/0140808 A1* 6/2006 Sbarounis ..... 418/61.2
2006/0193739 A1* 8/2006 Beaudoin ..... 418/61.2
2007/0014681 A1* 1/2007 Beaudoin ..... 418/61.2

FOREIGN PATENT DOCUMENTS

RU 2 140 018 C1 * 10/1999

* cited by examiner

ROTARY SCREW MACHINE OF VOLUME TYPE AND METHOD OF TRANSFORMING A MOTION IN A VOLUME SCREW MACHINE

CROSS-REFERENCE TO RELATED APPLICATIONS

This application is a U.S. National Stage entry under 35 U.S.C. § 371 of co-pending International Patent Application No. PCT/IB2003/003266, filed on Jul. 14, 2003 by GORBAN, Alexander entitled ROTARY SCREW MACHINE AND METHOD OF TRANSFORMING A MOTION IN SUCH A MACHINE, the entire contents of which is incorporated by reference. As in the International Application No. PCT/IB2003/003266, priority is claimed to European Patent Application No. 02291806.4, filed on Jul. 17, 2002, the entire contents of which is incorporated by reference, and for which priority is claimed under 35 U.S.C. § 119.

One aspect of the invention relates to a rotary screw machine of volume type comprising a body, two members consisting of a male member and a female member surrounding said male member, wherein an outer surface of the male member defines a male surface and a inner surface of the female member defines a female surface, said male and female surfaces being helical surfaces having respective axes Xm and Xf that are parallel and spaced apart by a length E, said male and female surfaces defining at least one working chamber by formation of linear contacts of said male and female surfaces and relative displacement of said male and female members, said male and female surfaces being further defined about said axes Xm and Xf by a nominal profile in a cross section of the mechanism, said profile of the male surface defining a male profile having an order of symmetry Nm with respect to a center Om located on said male axis Xm, said profile of the female surface defining a female profile having an order of symmetry Nf with respect to a center Of located on said female axis Xf, said rotary screw machine further comprising a crank like mechanism generating an eccentricity E between said main axis X and one of the axis Xm or Xf.

Such a rotary screw machine of volume type is known for transforming energy of a working substance (medium), gas or liquid, by expanding, displacing and compressing said working medium, into mechanical energy for engines or vice versa for compressors, pumps, etc.

Such a rotary screw machine of three-dimensional type is known from U.S. Pat. No. 5,439,359, wherein a male member surrounded by a fixed female organ is in planetary motion relative to the female member and wherein the outer surface of the male member defines a male surface and an inner surface of the female member defines a female surface, said male and female having parallel axis spaced apart by a length E (eccentricity).

A first component of this planetary motion drives the axis of the male surface to make this axis describe a cylinder of revolution having a radius E about the axis of the female surface, which corresponds to an orbital revolution motion.

A second component of this planetary motion drives the male member to make it rotate about the axis of its male surface. This second component (peripheral rotation), will in all the following text be called swiveling motion.

This known rotary screw machine has only two degrees of freedom and only one of them is independent, e.g. if an independent degree of freedom is the first component, orbital revolution of the male member, then the dependent degree of freedom is the swiveling motion of the male member, since the latter is guided in its swiveling motion by the contacts between the male and female surfaces, and vice versa.

Consequently, this rotary screw machine has limited technical potential and has significant heat losses.

It is an object of the present invention to provide a rotary screw machine in which technical and functional potential are broader, in reducing the angular extent of thermodynamic cycles, improving efficiency, and in which the overall heat losses are decreased.

The invention provides a rotary screw machine in which a first one of the male and female members is hinged in the body and is able to rotate on itself about its fixed axis according to a rotation motion, in which the crank organ is connected (hinged) to a second one of the male and female members to allow the axis of the second member to revolve about fixed the axis of the first member according to an orbital revolution motion having the length E as a radius, and which comprises a synchronizer for synchronizing the swiveling motion and the orbital revolution motion, one with respect to the other, so that the male and female surfaces mesh together.

In all the text, when the axis of a member moves in a circular orbit around a fixed axis of another member, it will be specified as to revolve an axis, and the process of the orbital rotation of a member axis in a circle around a fixed axis of another member, it will be specified as revolution.

In the process of revolution, when a movable member rotates about its own axis moving in orbit, it will be specified as to swivel a member, and the process itself of a peripheral rotation of a member about its own axis moving in orbit, it will be specified as swiveling.

Thus, the planetary motion represents the sum of revolution and swiveling. When swiveling is equal to zero and revolution is not equal to zero, then the planetary motion becomes a circular progressive motion.

The crank organ and the first one of the male and female members can be independently controlled leading to the independence of the rotation motion and the orbital revolution motion.

Thus, the rotary screw machine has two independent degrees of freedom. According to a preferred embodiment, the rotary screw machine further comprises a one-channel rotational transmission means connected to said crank organ or to said first member or a two-channel rotational transmission means connected to the crank organ and to the first member.

In this case, the crank organ and the first member are driven together with the rotational transmission means and with independent choice of motion speeds.

In a preferred embodiment, the male and female surfaces are brought in mechanical contact forming a kinematic pair allowing the transmission of motion between the first and second members.

Such a rotary screw machine has three degrees of freedom two of them being independent, which introduces an additional rotation motion of the first member. The axis of the second member is able to revolve about the axis of the first member and the second member itself is able to swivel about its movable axis due to the self-meshing of the male and female surfaces, which leads to a planetary motion of the second member relative to the first member axis, the first member itself being able to rotate about its fixed axis.

In particular, when the number of forming arcs of the female is higher than the forming arcs of the male profile, then synchronization is provided by self-meshing of the elements, i.e. without special synchronizing mechanisms.

According to a preferred embodiment, when mechanical contacts are undesirable or not easy to obtain or just to improve the drive of the second member, the rotary screw machine further comprises an additional synchronizer, linked to the body and allowing the second member to swivel about its axis.

According to the type of additional synchronizer, for example a planetary gear, the swiveling motion speed of the second member is proportional (preferably increased, that is with a coefficient of proportionality greater than one) to the swiveling motion speed of the first member.

According to a preferred embodiment, the rotary screw machine further comprises rotational transmission means connected to the crank organ and to one of the male or female members.

The first and second members being both in rotation and swiveling motion, the rotation transmission means can be connected either with the first and/or the second member and/or crank according to the specific arrangement of the elements composing the rotary screw machine. Thus, the first member can be driven by the second member, which is then the driving member and which is itself connected to the rotational transmission means and vice versa.

In a preferred embodiment, the synchronizer further comprises a kinematical coupling mechanism of both members together, the kinematical coupling mechanism comprising at least one coupling organ, which is hinged in the body.

Thus, the both crank organ and the driving member, else the crank organ or the driving member can be driven by the rotational transmission means, so that their motions can be equal or different relative to each other. The relation between their motions is given by the type of coupling organs chosen.

In a preferred embodiment, the kinematical coupling mechanism comprises a planetary gear whose disposition between the crank organ and the driving member can lead to a multiplication or a reduction of the element being driven by the planetary gear relative to the element connected to the rotational transmission means.

In a preferred embodiment, the synchronizer comprises a planetary gear transmission, or an inverter or a coulisse mechanism.

The inverter is used to inverse the way of the rotation motion of the second member axis relative to the rotation motion of the first member. According to the disposition of the planetary gear relation with the second member, both preceding motions can occur in the same direction or in an opposite direction. Thus, the inverter can be used either in addition or substitution of the planetary gear transmission.

The efficiency of the rotary screw machine being proportional to the speed of the cycles consisting in opening and closing the chambers defined between the first and second surfaces, it is all the higher since both first and second members are in motion. However, the best result is obtained when the rotation motion speed of the first member is equal to the revolution motion speed of the second member axis, but occurs in the opposite direction of rotation. In this case, the mechanical strengths applied by the first and second members against the body are equal and opposite, such that the resultant momentum is practically nil. These kinds of machines are used in cases where the vibrations are to be avoided or greatly limited. Generally, two or more rotating elements of rotary screw machines (including contra-rotating elements) can be coupled through transfer mechanisms to rotating elements of outer units or mechanisms. The coupling of this type can be carried out, e.g. in combined operation of contra-rotating volume machine in the mode of engine with outer contra-rotor devices such as contra-rotor turbine, contra-rotor compressor or contra-rotor electrical machine, contra-rotor wings of air or sea vehicles, contra-rotor cutting tools etc.

The efficiency of the rotary screw machine can also be improved in increasing the number of first and second members.

Thus, according to a preferred embodiment, the rotary screw machine further comprises either at least one additional male and female members disposed in line with the said male and female members, or at least a third member disposed inside or surrounding the male and female members, in such a way that their surfaces are in mechanical contact so as to form additional chambers.

In a preferred embodiment, the female order of symmetry Nf is equal to Nm−1, or Nm+1.

To make the realization easier of both male and female members, they can be done as an assembly of a plurality of identical members having ad hoc nominal profile and being oriented relative to each other so as to define at least one working chamber that extends axially. The angular distance between two consecutive elements is directly linked to the number of elements chosen.

When the number of elements is finite, the working medium with which the machine exchanges energy can be admitted via a cross section at one end of the mechanism and can escape via its other end.

In a preferred embodiment, the male and female surfaces can degenerate into cylindrical surfaces.

Another aspect of the invention relates to a method of transforming a motion in a volume screw machine.

The invention relates to a method of transforming a motion in a volume screw machine with inner conjugation of screw members with a positive displacement of volumes of working chambers of three-dimensional (3-D) type, which are formed by a conjugated enclosing (female) and enclosed (male) screw members.

Methods of transforming a motion are used for conversing a mechanical energy of a motion and working substance energy in working chambers of a screw machine, and for transmitting a positive energy flow of conversion. It is significant that conversion and transmission of a positive energy flow of conversion is a reversible process. The methods are based on the creation of interconnected relative motions of synchronizing coupling links and the screw conjugated male and female members, which form with their inner and outer helicoidal surfaces the working chambers moving axially in the process of transforming a motion.

The known methods of transforming a motion in volume screw machines under conversion of a positive energy comprise: transmission of positive energy flow of conversion through a kinematics channel of a mechanical rotation formed by the independent degree of freedom of the members executing a planetary motion, driving one of male or female members into planetary motion with two degrees of freedom of mechanical rotation, of which one being an independent degree of freedom relative to the fixed central axis of the other member.

On one hand, an outer envelope of the male profile can be an initial trochoid of symmetry order Nm, then the internally conjugated female profile presents an outer envelope of a family of trochoids of symmetry order Nf=Nm+1 and both profiles have constantly Nm+1 points of contact.

On the other hand, an outer envelope of the male profile can be made as an inner envelope of a trochoid family mentioned above of symmetry order Nm, and the female profile is, in this case, a trochoid of symmetry order Nf=Nm−1 and both profiles have constantly Nm points of contact.

In both cases, the contact points are kinks of one of the envelopes and make possible to insulate constantly the working chambers via the contacts between female and male surfaces. The inner female surface and outer male surface are screw surfaces with parallel axes, some of them can be movable and spaced at a distance, which we denote as the eccentricity E.

In the known methods of transforming a motion in volume screw machines the coordinated motion of the members with the pitches (periods) Pm and Pf of twist of the rated profiles of the end sections of the members is executed. The initial twist is performed in a pair of conjugated members in the planes, which are normal to the longitudinal principal axis of the screw members, and is a birotative process of a turn of the end sections about their central axis. Relationship of the pitches of the female and male surfaces is determined by relation of the symmetry orders of mentioned profiles according to $$\frac{Pf}{Pm} = \frac{Nm+1}{Nm}.$$

In the known machines with an inner envelope, the quantity of the working chambers are equal Nm, and an axial pitch of each working chamber is equal Pm, whereas in the known machines with an outer envelope, the quantity of the working chambers are equal Nm+1, and an axial pitch of each working chamber is equal Pf.

At the finite values of Pm and Pf, in the process of transforming a motion of the members with the help of synchronizing coupling links (or by self-synchronization in the machines with an outer envelope), it is possible to set in a planetary motion of any one of the members (male or female) with respect to the other (fixed) member with two degrees of freedom, one of which being an independent degree of freedom of a mechanical rotation.

All known methods of transforming a motion in volume screw machines of inner conjugation amount to the next two methods: rotary (more often called as birotative) and planetary methods.

According to the first method a rotation (rotation of a member about its own fixed axis) in one direction about a fixed parallel axis, is imparted simultaneously to the interconnected rotation of the two links—female and male members with the initial and conjugated screw profiles.

According to the second one, the planetary motion is imparted to one member (it is technically preferable to impart the planetary motion to male member), so that its center is moved in a circle around the center of the second member, in this case, the fixed member (female member).

Generally, with the help of synchronizing coupling links (or by self-synchronization in the machines with an outer envelope), it is possible to set in a planetary motion of any one of the members (male or female) with respect to the other fixed member, with the two degrees of freedom one of which being independent.

In the known methods, a fixed female member generally sets the male member in a planetary motion relative to the fixed central axis of the female member and surround it.

As it was shown above, a planetary motion can be represented as a sum of two components of the rotations—revolution and swiveling. The first component of rotation of this planetary motion makes the axis of the male surface describe a cylinder with a radius E about the central axis of the female fixed surface, herewith an axis of the planetary member revolves in orbit of radius E at an arbitrary speed ω. The second component of this planetary motion is swiveling, i.e. a peripheral rotation of the male member about its movable axis at the $$\text{speed} \pm \frac{\omega}{Nm}$$

(minus-when the male member is trochoidal, plus-when the male member is an inner envelope).

Effectiveness of the method of transforming a motion in the particular screw machine is determined by intensity of the thermodynamic processes taking place in the machine, and is characterized by the generalized parameter "angular cycle". The cycle is equal to a turn angle of any rotating member (male, female or synchronizing link) chosen as a member with an independent degree of freedom.

In the known methods, performing a function of the kinematics channel of admission and escape of positive energy of conversion can be an output shaft of synchronizing link, e.g. a crank shaft of the male member and so on.

The angular cycle is equal to a turn angle of a member with independent degree of freedom at which an overall period of variation of the cross section area (or overall opening and closing) of the working chamber, formed by the male and female members takes place, as well as axial movement of the working chamber by one period Pm in the machines with an inner envelope or by one period Pf in the machines with an outer envelope.

On transforming a planetary motion of a female member, made as an outer envelope, revolution of male member axis can be chosen as an independent rotation and swiveling of the male member is a dependent rotation. Then the angular cycle is defined by the angle of revolution of the male member's axis, which is equal to $$\gamma = \frac{\pi Nm}{Nm-1}.$$

This angle is equal the turn angle of a crankshaft of the synchronizing link (with which the male member, hinged on the crank, executing the swiveling motion in the process of a planetary motion) and when a positive mechanical energy is admitted through the kinematics crank-channel with an independent degree of freedom.

On admitting a positive energy of mechanical rotation directly to a male member, the swiveling motion of the male member is chosen as the independent rotation, and the revolution of the male member axis as a dependent one. Swiveling of the male member with independent degree of freedom about its own movable axis through self-synchronizing conjugation of male and female members causes an axis revolution (dependent degree of freedom) in an orbit with E radius about a fixed axis of the female member. The angular cycle in this case is equal to $$\gamma = \frac{\pi}{Nm-1}.$$

The known methods of transforming a motion are used in particular in downhole motors in petroleum, gas or geothermal drilling (such as described in French Patent FR-A-99 7957 and U.S. Pat. No. 3,975,120).

The transformation of a motion used in motors is described by V. Tiraspolskyi ("Hydraulical Downhole Motors in Drilling", the course of drilling, pp.258-259, Published in Edition, Technip, Paris 15e). Similar transformation of a motion in those motors is carried out usually at fixed female member, which is a female member, while the planetary motion of the male member relative to this female member is accordingly identified by its absolute motion.

The known methods of transforming a motion in volume screw machines with conjugated elements of a curvilinear shape realized in the similar volume machines have the following drawbacks:

limited technical potential, because of imperfect process of organizing a motion, which fails to increase a quantity of angular cycles per one turn of the drive member with the independent degree of freedom;

limited specific power of similar screw machines;

limited efficiency;

existence of reactive forces on the fixed body of the machine.

The invention is intended to solve a problem of widening technical and functional potential capabilities of the method of transforming a motion in screw machines by creating an additional kinematics channel for positive energy of conversion with the independent degree of freedom of a motion, i.e. by increasing the total quantity of degrees of freedom of rotary motion up to the three, of which two of them are independent. It provides an increase in the efficiency of the method, an increase in quantity of angular cycles of volume change of the displacing chambers per one turn of a drive shaft and, as a result of which, to intensification of conversion processes of positive energy and decrease (up to zero) in the mechanical reactive forces on the supports of the volume screw machine.

According to the second aspect of the invention, the second independent degree of freedom of rotary motion is introduced in transforming a motion of male and female members and links of synchronizing coupling. On transforming a planetary motion the member, an axis of which is in coincidence with a central fixed axis, is actuated into a rotary motion about the fixed axis with independent degree of freedom of a rotary motion. For this purpose a portion of the positive energy of conversion is transmitted through the second independent degree of freedom of mechanical rotation of the member executing a rotary motion about central fixed axis.

In the method according to the invention, the differential interconnected rotary motions of a link of synchronizing coupling and male and female members are executed. Any two rotations of said three ones (rotation, revolution and swiveling) are chosen as independent degrees of freedom of rotary motion and the third rotation is a dependent differential function of the two independent rotations, herewith the revolution of the axis of a planetary element about central fixed axis at radius E is created simultaneously with swiveling of this element and with a rotation of another conjugated element about its central fixed axis.

A method of transforming a motion in a volume screw machine according to the invention, comprises the creation of interconnected motions of the screw conjugated elements in the form of male and female members and links of synchronizing coupling with the help of converted positive flows of mechanical energy and working substance energy in working chambers of said volume screw machine, driving one of male or female member into a planetary motion with two degrees of freedom of mechanical rotation one of which being an independent degree of freedom, the transmission of said positive energy flow of conversion through an independent degree of freedom of a mechanical rotation of said machine.

In a preferred embodiment, the method provides the creation of a differentially connected motion of male and female members and links of synchronizing coupling with the second independent degree of freedom of a rotary motion and the transmission of positive energy flow of conversion in the form of the two flows through the two independent degrees of freedom of a mechanical rotation of said machine.

Furthermore, according to another embodiment, at least, one dependent degree of freedom of rotary motion can be created in the process of transforming a motion of male and female members and links of synchronizing coupling, and a part of positive energy flow of conversion inside said machine can be used in transforming a motion through an additional dependent degree of freedom of mechanical rotation of said machine with decreasing the number of independent degrees of freedom per unity.

According to another embodiment, the angular velocities of said members can be determined as differentially connected to one another according to the relation:

$$k_1\omega_1+k_2\omega_2+\omega_3=0,$$

where: $\omega_1,\omega_2$ represent the angular speed of the said conjugated elements about their axis;

$\omega_3$ represents the angular speed of the link of synchronizing coupling;

$k_1,k_2$ represent the constant coupling coefficients; herewith, values of angular velocities of rotation of conjugated elements are defined from relation:

$$(z-1)\omega_1-z\omega_2+\omega_0=0,$$

where: $\omega_1$ represents is the angular speed of the member around its axis, enveloping surface of which has the form of curvilinear surface;

$\omega_2$ represents the angular speed of rotation of the member around its axis, enveloping surface of which has a shape of inner or outer envelope of a family of surfaces, formed with the said curvilinear surface;

$\omega_0$ represents the angular speed of the orbital revolution of the axis of the member executing planetary motion;

z represents an integer, z>1.

Furthermore, according to another embodiment of the method, any two of the three rotations can be synchronized between one another, namely, the rotation of one of the conjugated elements about their fixed axis, the revolution of an axis of the element performing a planetary motion with the link of synchronizing coupling and the swiveling of the element with a movable axis.

The rotary screw machine of the present invention will be more fully understood with reference to the accompanying figures that show non-limiting examples.

Figure 2:
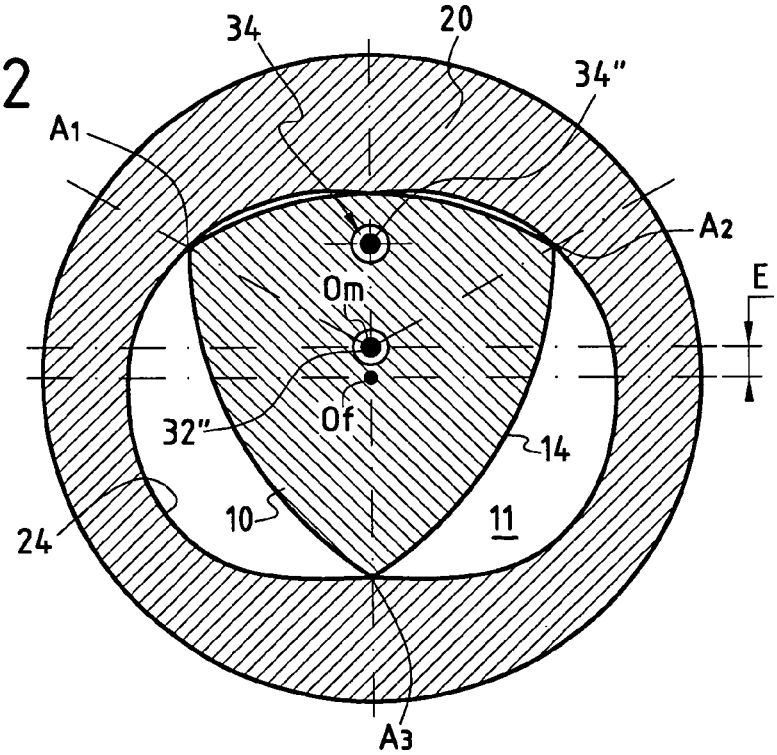
Figure 3:
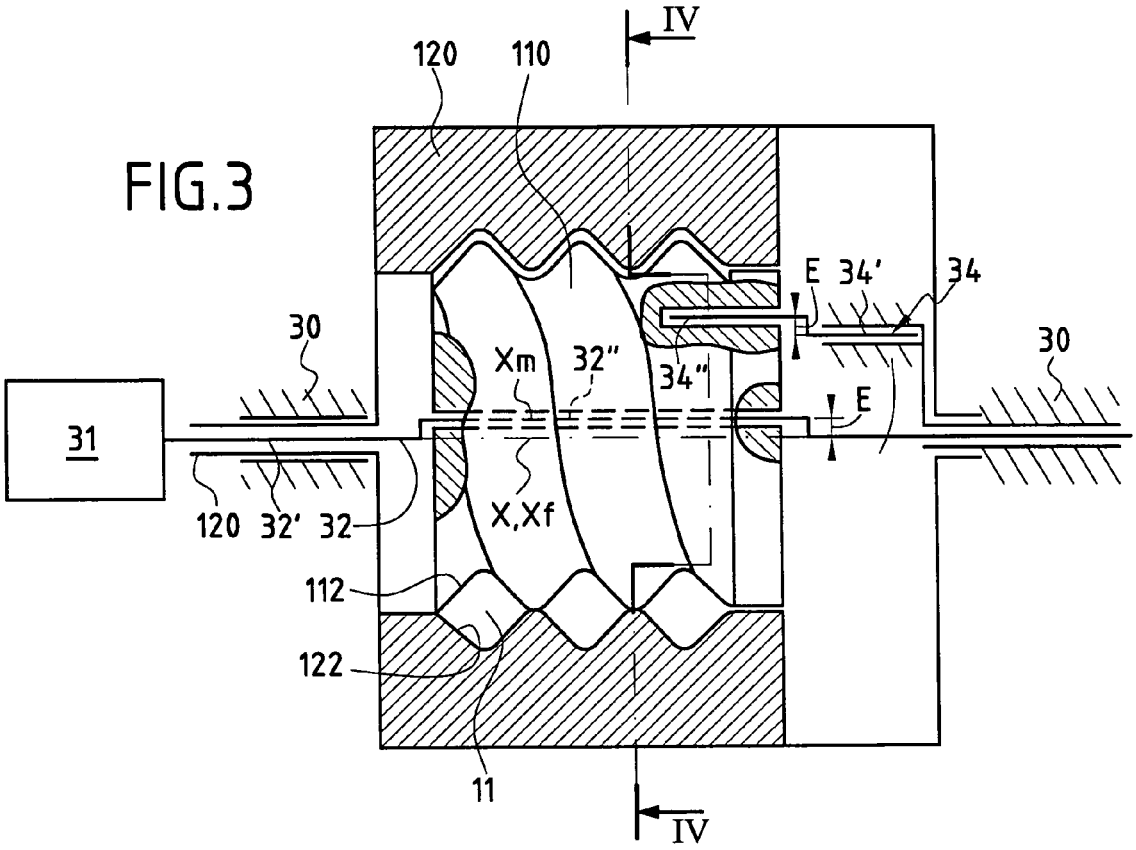
Figure 4:
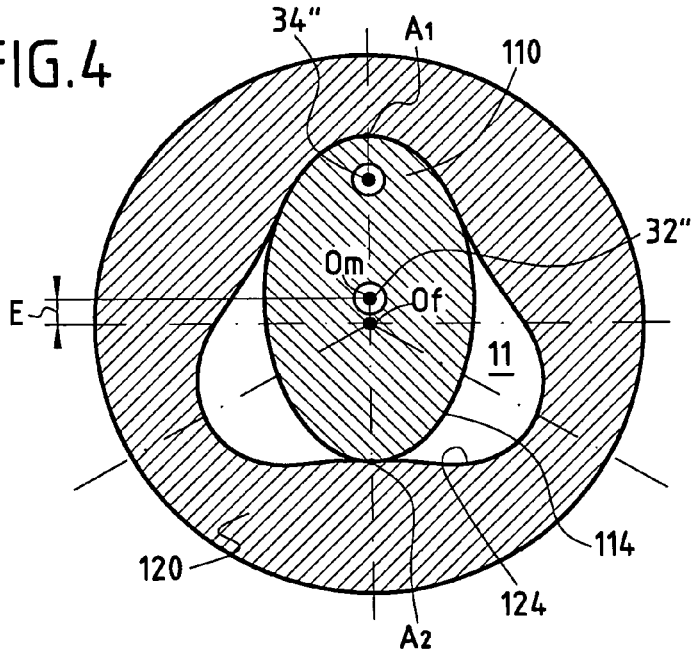
Figure 5:
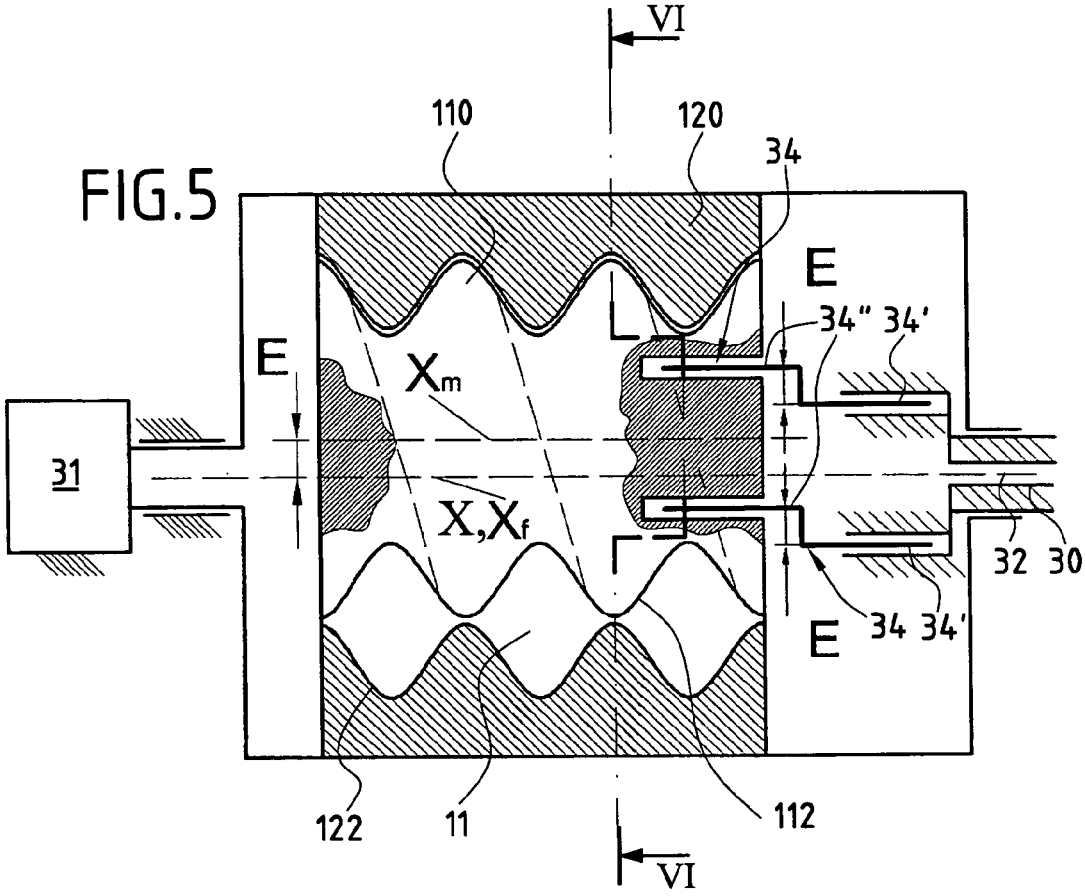
Figure 6:
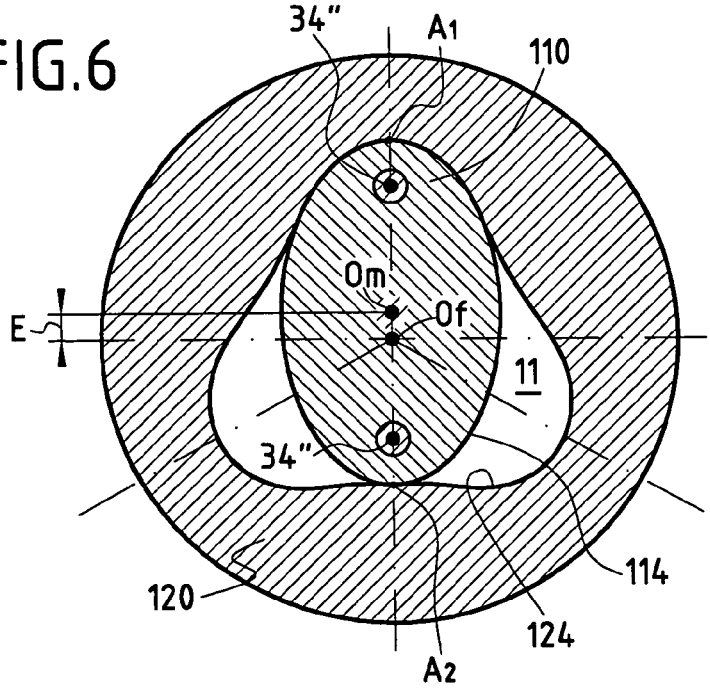
Figure 7:
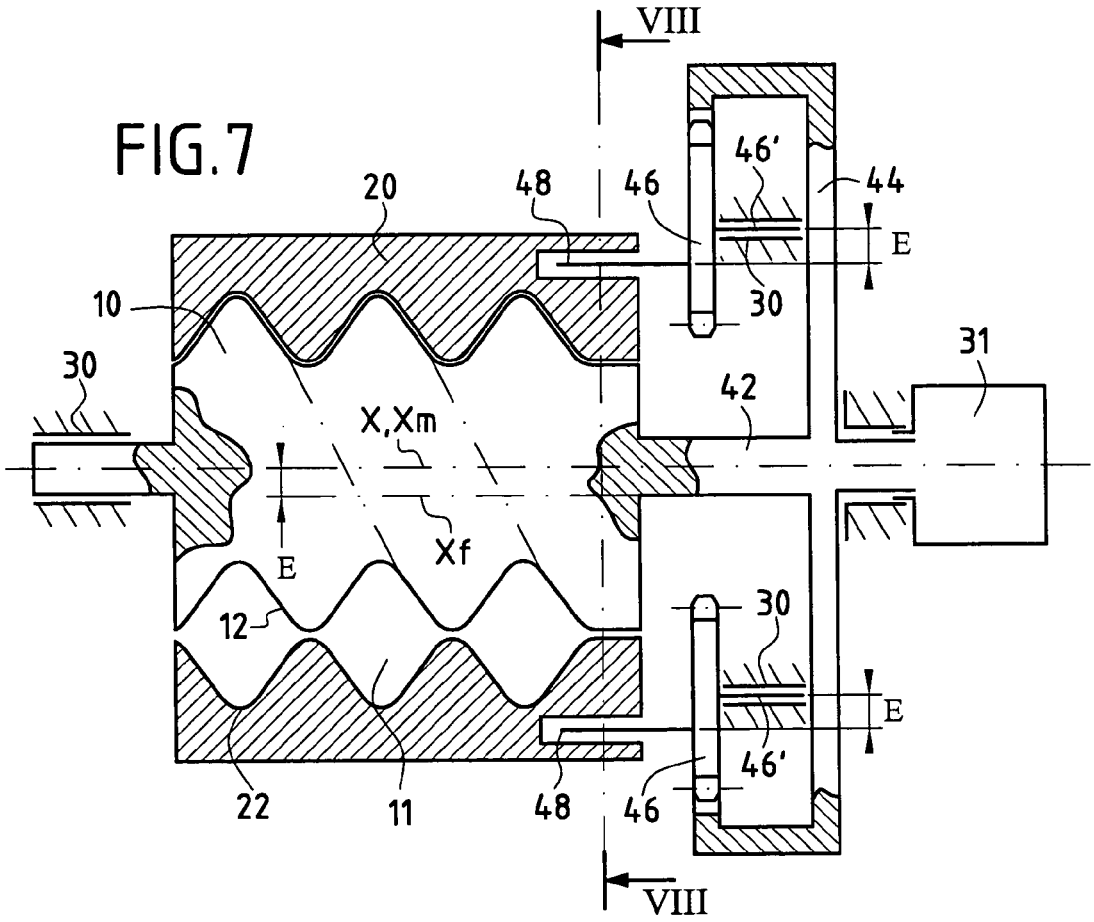
Figure 8:
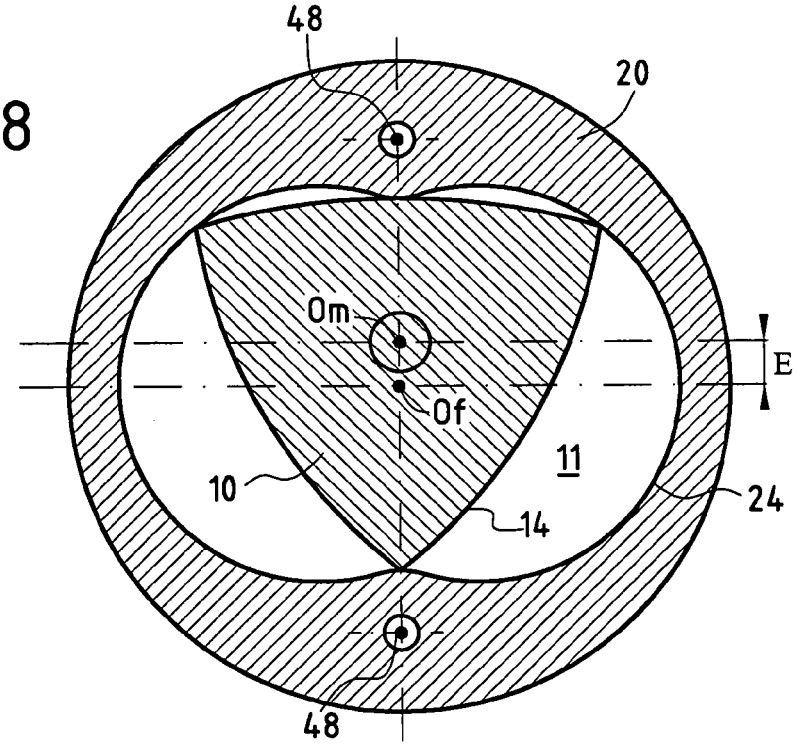
Figure 9:
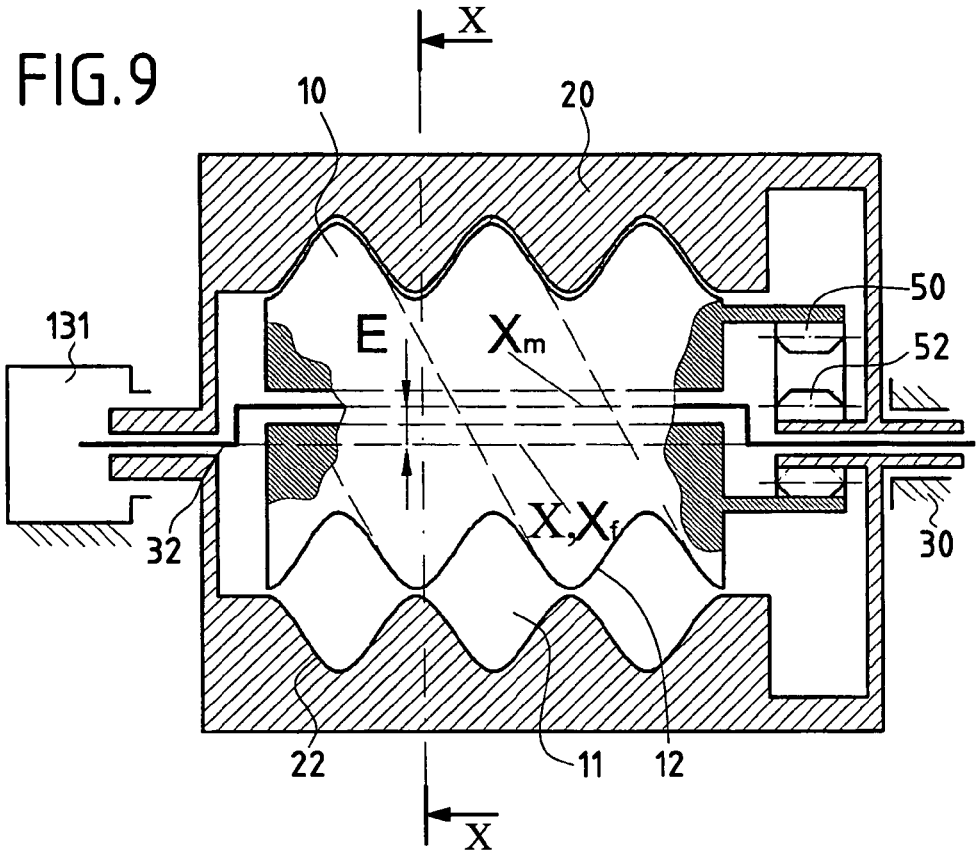
Figure 10:
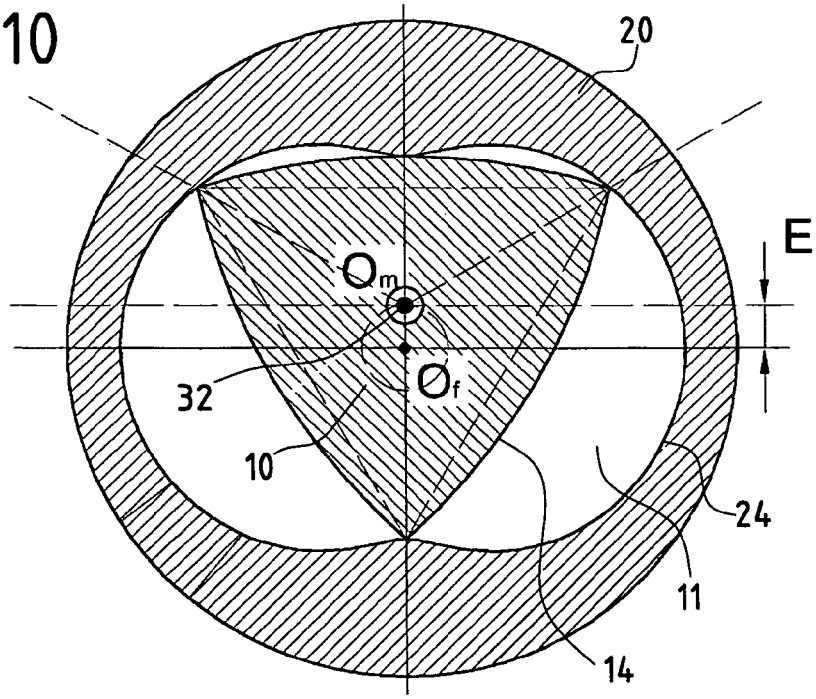
Figure 11:
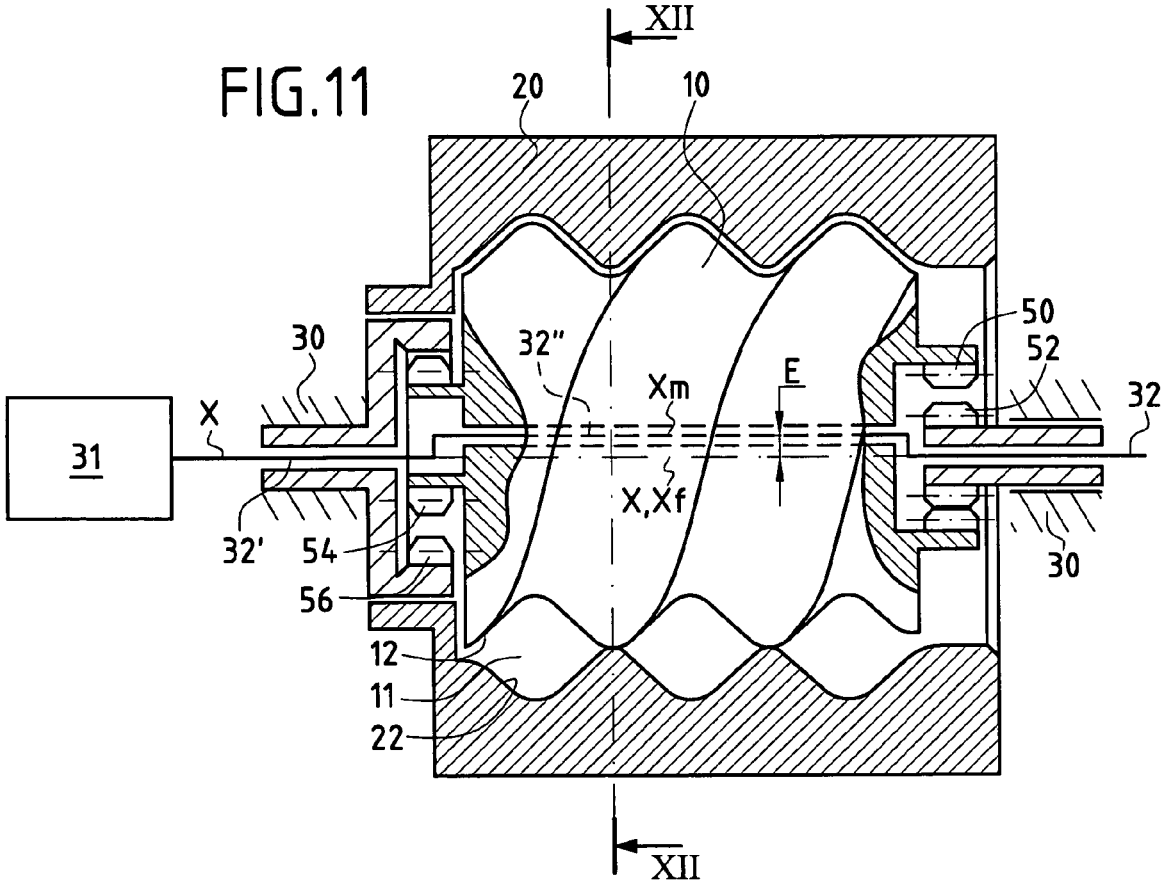
Figure 12:
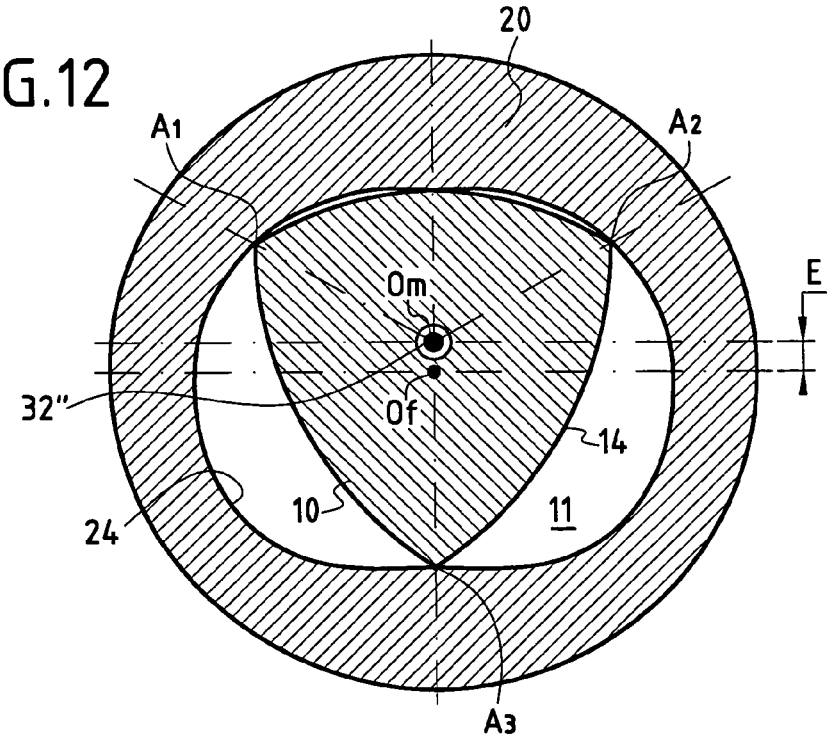
Figure 13:
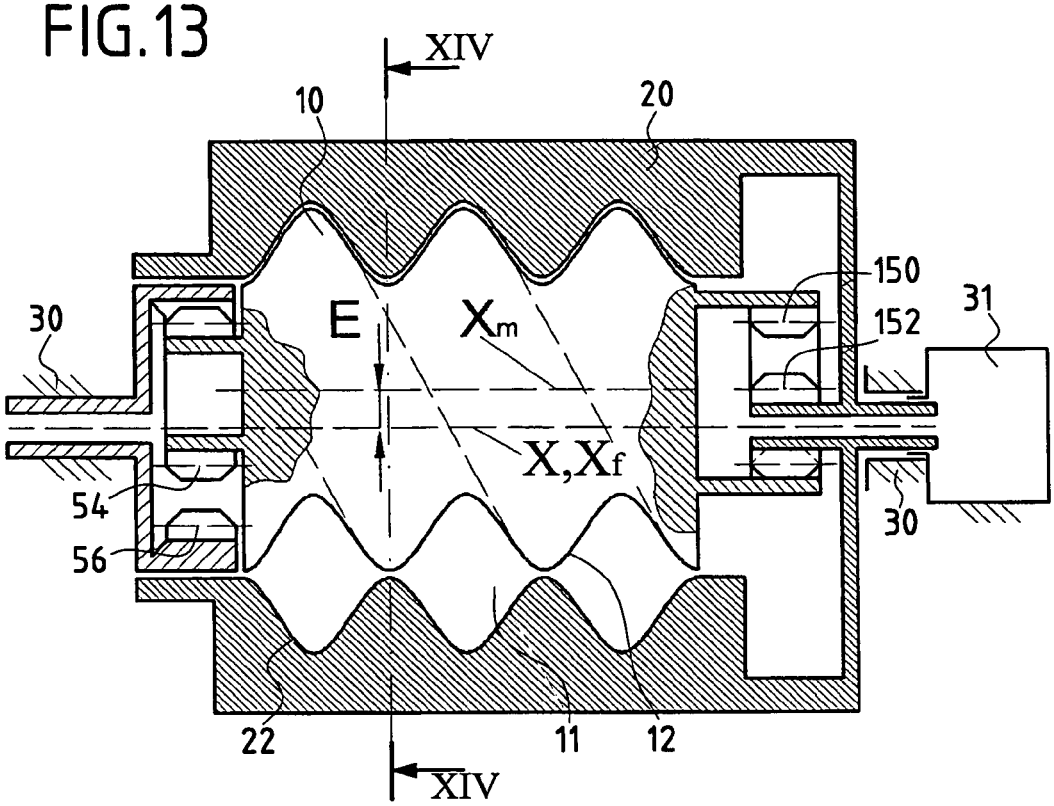
Figure 14:
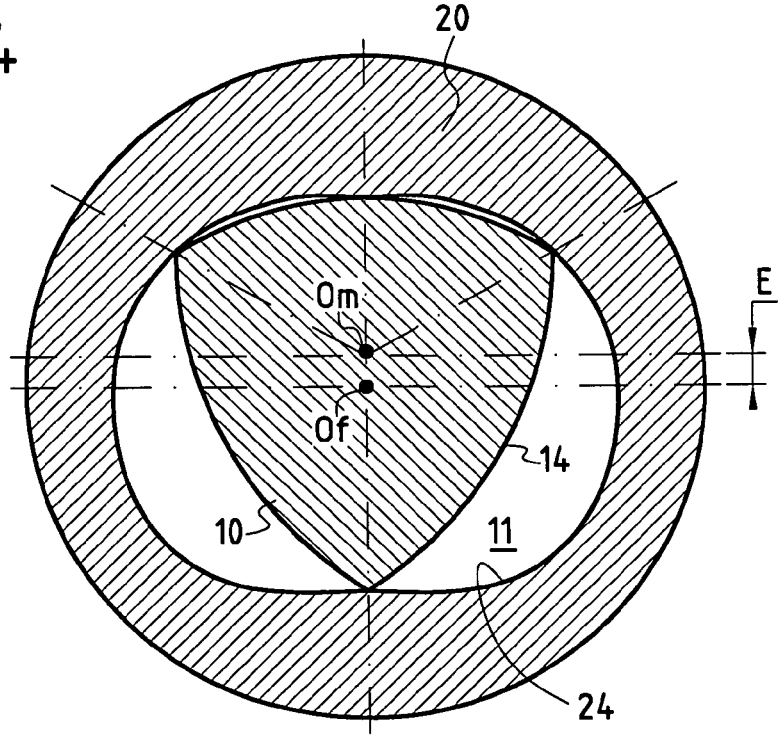
Figure 15:
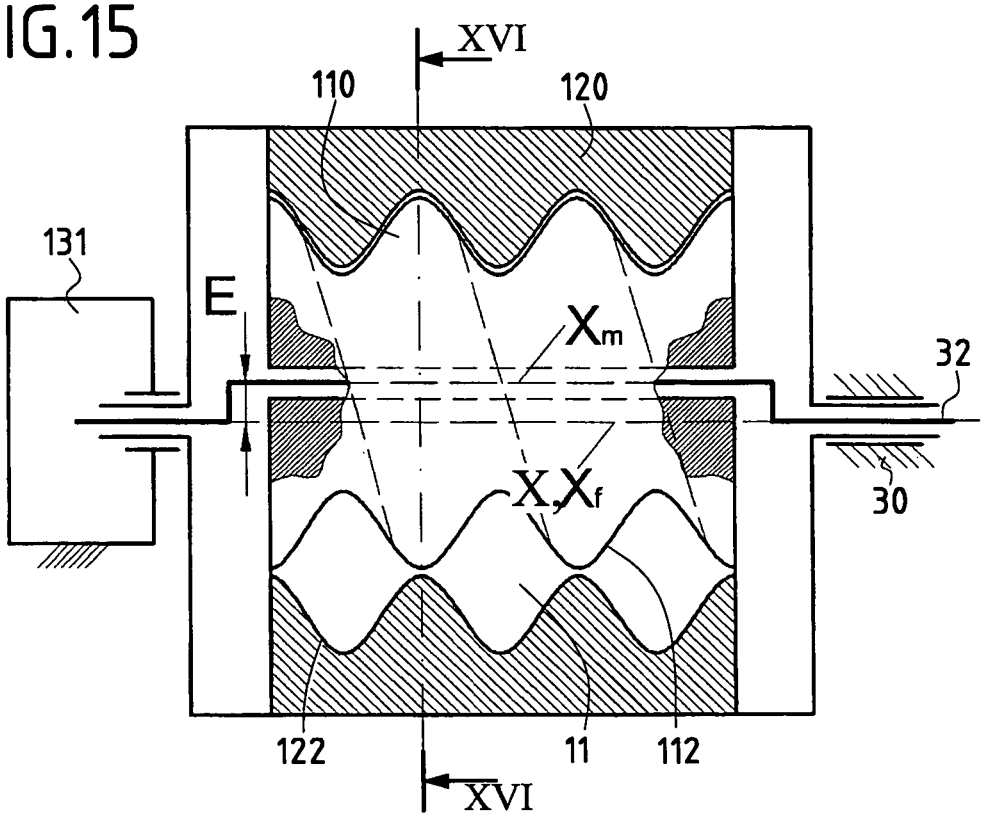
Figure 16:
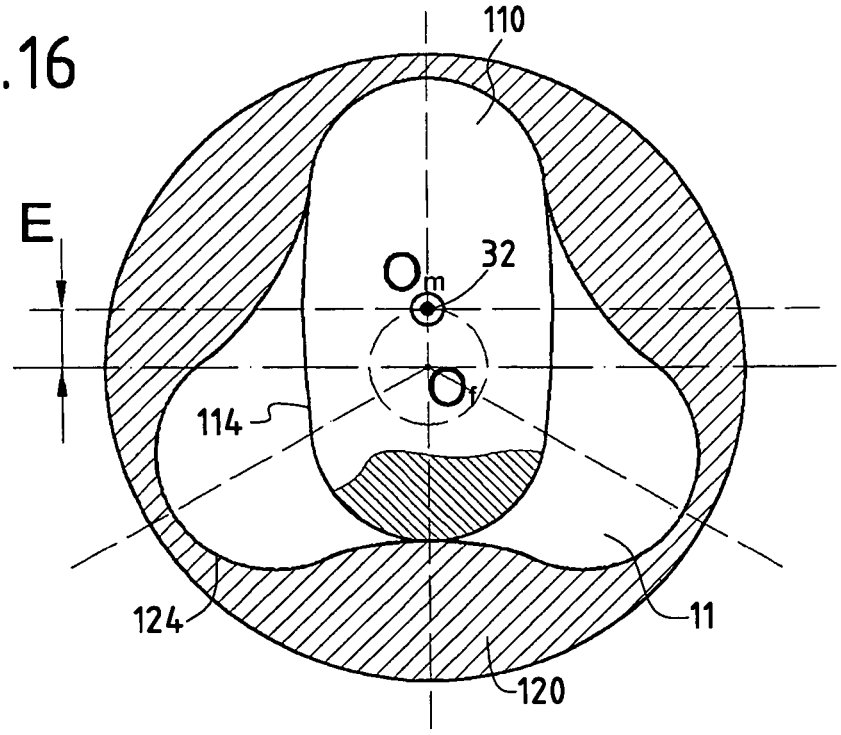
Figure 17:
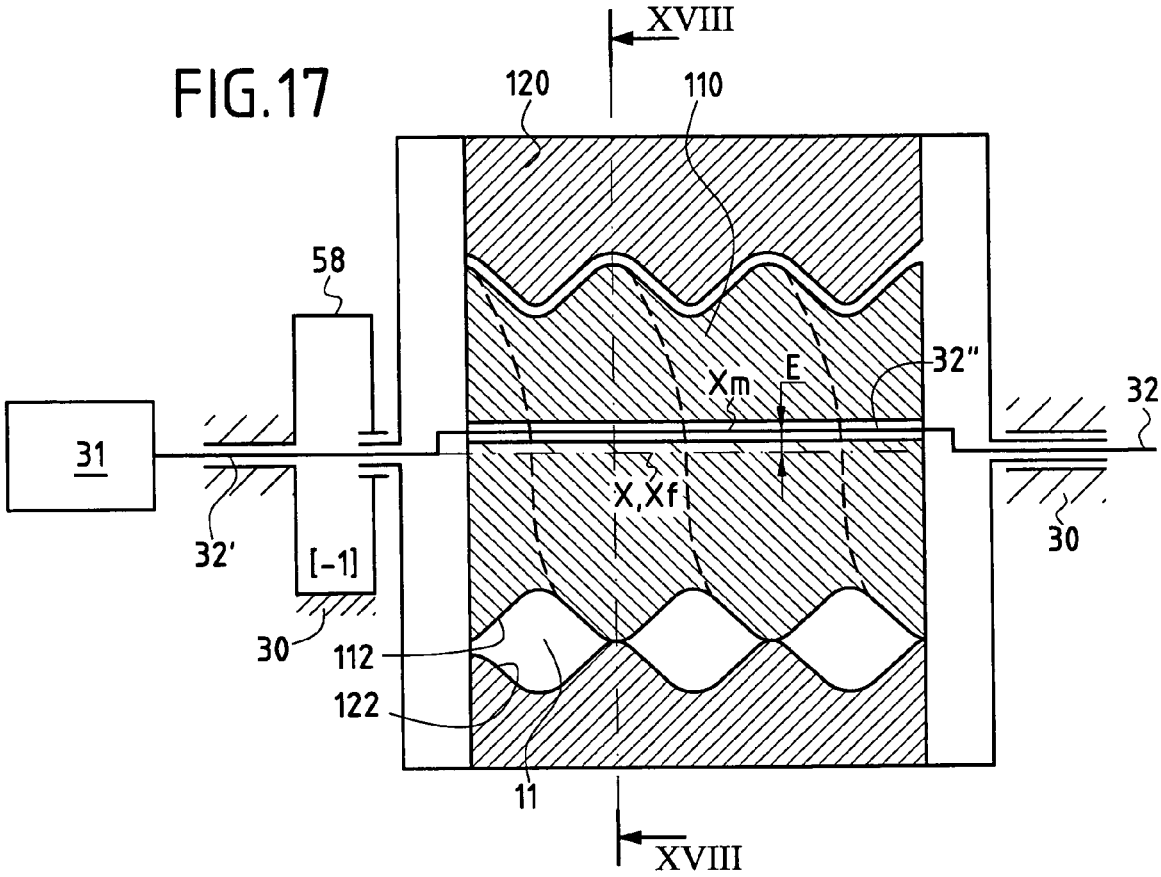
Figure 18:
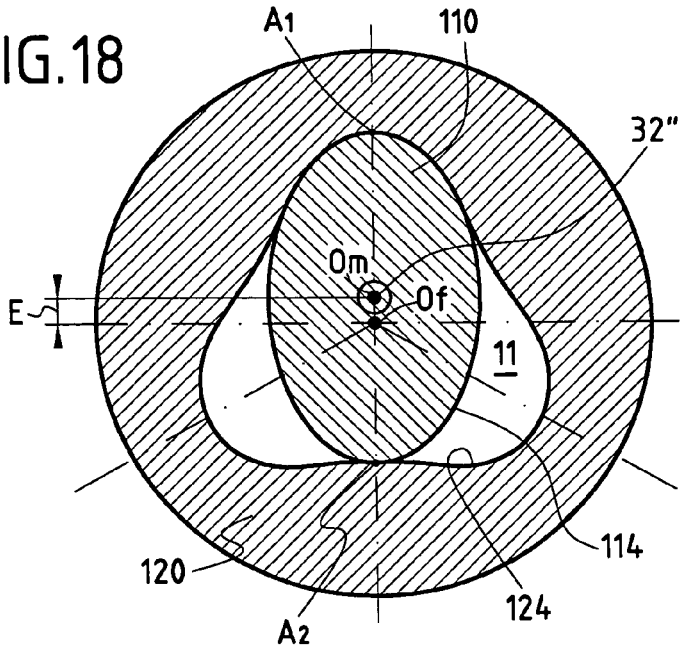
Figure 19:
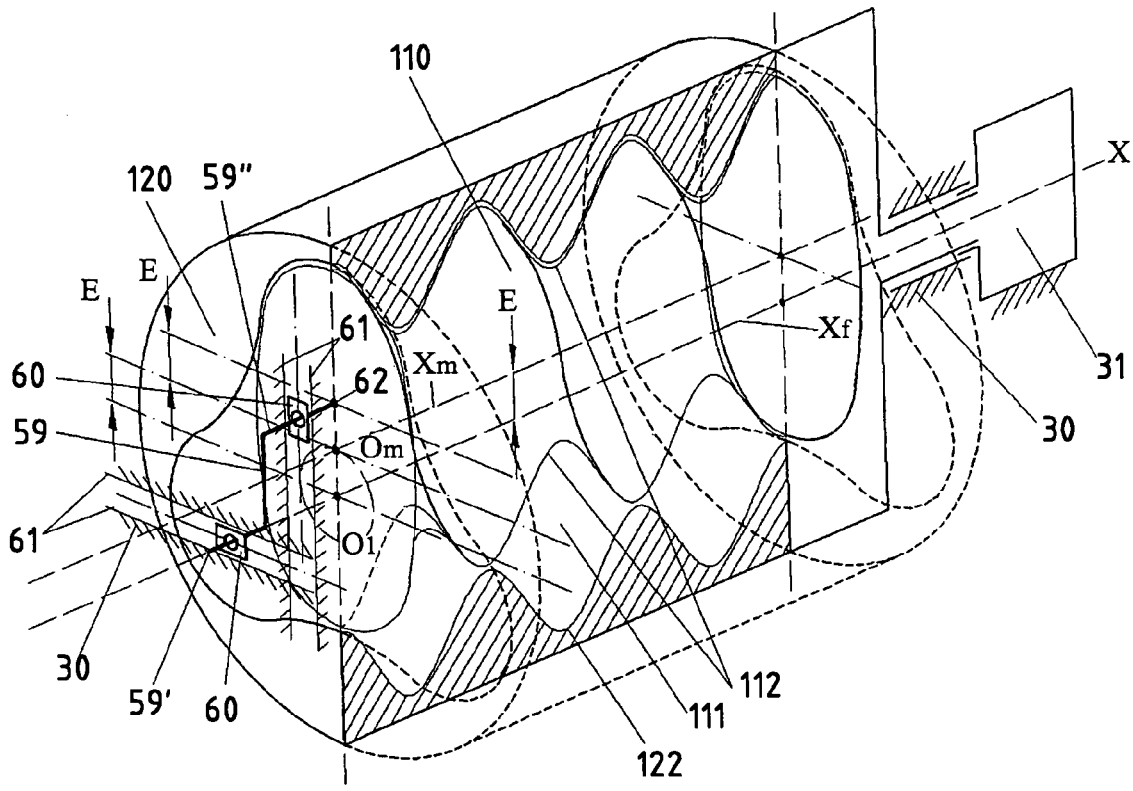
Figure 20:
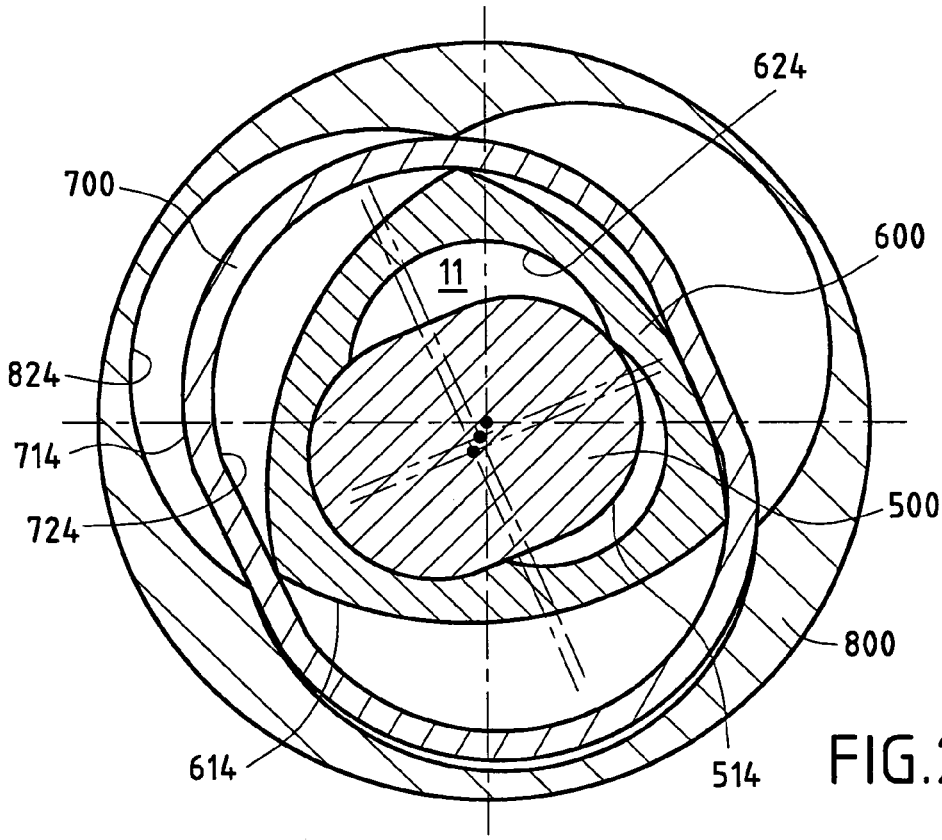
Figure 22:
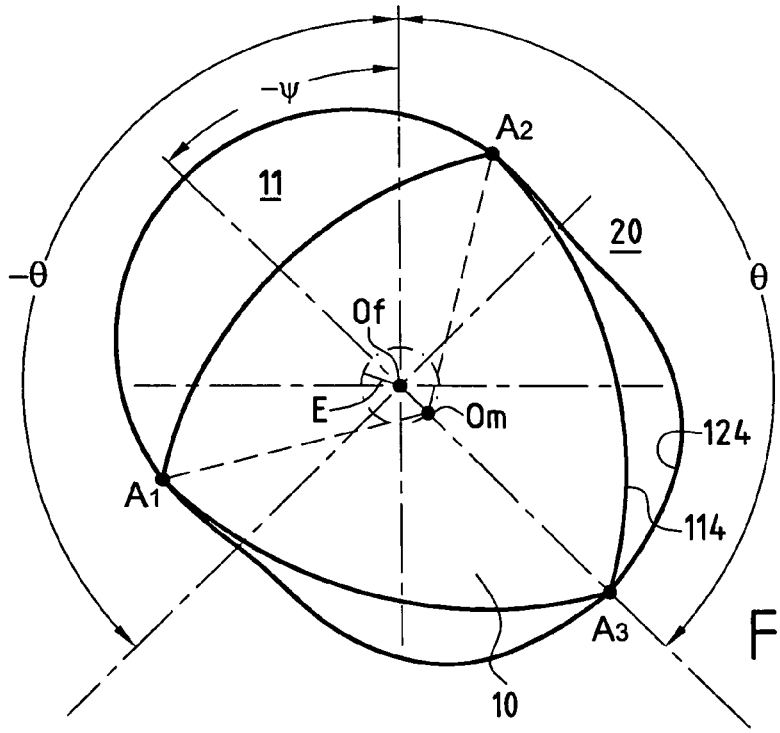
Figure 21:
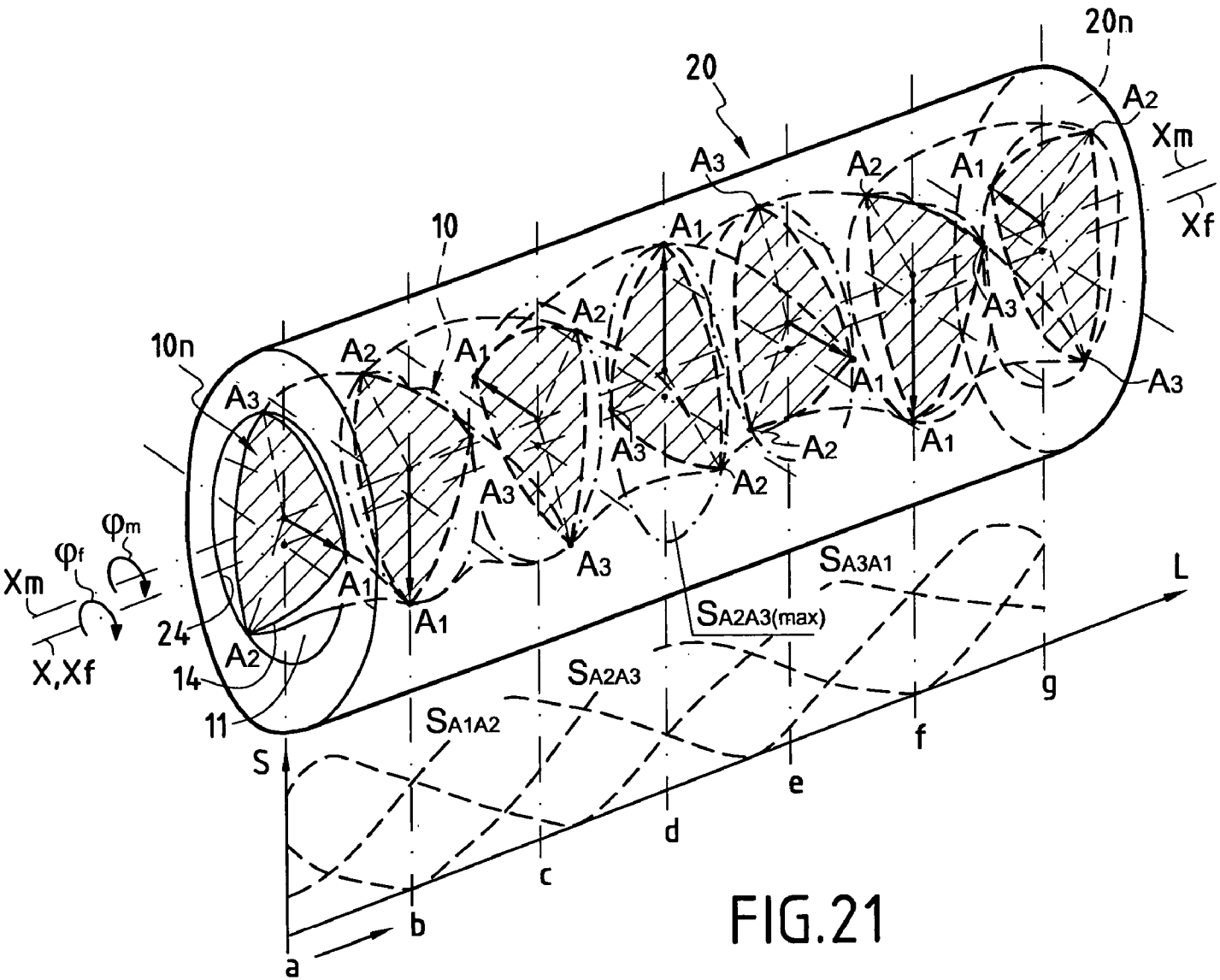

FIG. 1 shows a longitudinal section of a rotary screw volume machine embodied with rotational motion of female member and circular progressive motion of the male member with an inner envelope, in which Nf=Nm−1, FIG. 2 is a cross section on the line II-II of FIG. 1, FIG. 3 shows a longitudinal section of the rotary screw volume machine embodied with rotational motion of female member and circular progressive motion of the male member with an outer envelope, in which Nf=Nm+1, FIG. 4 is a cross section on the line IV-IV of FIG. 3, FIG. 5 shows a longitudinal section of the screw volume machine embodied with rotation of female member with an outer envelope, in which Nf=Nm+1 and circular progressive motion of the male member, FIG. 6 is a cross section on the line VI-VI of FIG. 5, FIG. 7 shows a longitudinal section of another embodiment of a rotary screw volume machine with rotational motion of male member and circular progressive motion of the female member, in which Nf=Nm−1, FIG. 8 is a cross section on the line VIII-VIII of FIG. 7, FIG. 9 shows a longitudinal section of a contra-rotating screw volume machine with two-channel rotational transmission means and with planetary motion of male member and rotational motion of the female member, in which Nf=Nm−1, FIG. 10 is a cross section on the line X-X of FIG. 9, FIG. 11 shows a longitudinal section of a contra-rotating rotary screw volume machine with one-channel rotational transmission means and with planetary motion of male member and rotational motion of the female member, in which Nf=Nm−1, FIG. 12 is a cross section on the line XII-XII of FIG. 11, FIG. 13 shows a longitudinal section of a contra-rotating screw volume machine with one independent degree of rotation of the female member, in which Nf=Nm−1, FIG. 14 is a cross section on the line XIV-XIV of FIG. 13, FIG. 15 shows a longitudinal section of a contra-rotating screw volume machine with two independent degrees of revolution of crank passing through male axis and rotation of the female member in which Nf=Nm+1, FIG. 16 is a cross section on the line XVI-XVI of FIG. 15, FIG. 17 shows a longitudinal section of a contra-rotating screw volume machine with planetary motion of male member and rotational motion of the female member, in which Nf=Nm+1, FIG. 18 is a cross section on the line XVIII-XVIII of FIG. 17, FIG. 19 illustrates a schematic view in perspective of a rotary screw volume machine with a coulisse mechanism with planetary motion of the male member, in which Nf=Nm+1, FIG. 20 shows a cross section of working chambers of a rotary screw volume machine with additional male and female members being coaxially disposed, FIG. 21 is an exploded view in perspective, explaining the method of transforming the motion in the rotary screw volume three-dimension machine, the principle of forming envelope curvilinear surfaces of the male and female members, and FIG. 22 illustrates a scheme, explaining the method of transforming the motion in a contra-rotating screw volume machine with planetary motion of the male member, in which Nf=Nm−1.

The rotary screw volume three-dimension machine of FIG. 1 illustrates a circular progressive motion of male member 10, i.e. an axis of the male member 10 is able to perform only an orbital revolution motion, and swiveling motion of member 10 is absent, whereas a female member 20 is able to rotate on itself.

The circular progressive motion of the male member 10, an axis of which Xm revolves in orbit of E radius about the fixed axis Xf of female member 20, is characterized by that a straight line connecting any two points of the male member 10 moves parallel to its initial direction. When the male member 10 moves in a circular progressive motion, its peripheral velocity about its movable axis Xm is equal to zero, i.e. its swiveling motion is absent.

In the embodied machine of FIG. 1, the male member is formed of a three-arc screw shape outer surface 12 (Nm=3), whereas the female member has a two-arc screw shape inner surface 22 (Nf=2). The outer surface of the male member 10 defines a male surface 12 and an inner surface of the female member 20 defines a female inner surface 22. The male 12 and female 22 surfaces are helical surfaces having parallel axes Xm and Xf spaced apart by a length E. The male 12 and female 22 surfaces define at least one working chamber 11 by evolution of linear contacts $A_1$, $A_2$ and $A_3$, of the male 12 and female 22 surfaces and relative displacement of the male 10 and female 20 members.

The nominal profile 14 of the male member 10 having an order of symmetry Nm=3 with respect to a center Om located on the male axis Xm is represented in a cross section of the rotary screw volume three-dimension machine given on FIG. 2. In the same way, the nominal profile 24 of the female member 20 has an order of symmetry Nf=2 with respect to a female center Of located on said female axis Xf, with Nf=Nm−1.

As represented on FIG. 2, the male profile 14 is composed of three identical lobes that cover the same angular sector with an angle of apex Om equal to 120°. The same appears with the two lobes of the female profile 24 that are diametrically opposed. The number of such lobes gives the order of symmetry.

The female member 20 is hinged in a stationary main body 30 having a main axis X and is mechanically connected to a one-channel transmission means 31, in a pivot link so as to be able to rotate on itself about this main axis X, which is here mixed with its female axis Xf.

The rotary screw volume machine further comprises a crank like mechanism having a crank organ 32 which hinged connects the main body 30 and the male member 10, and presenting an eccentricity equal to E. In fact, the crank organ 32 is composed by a first shaft like end 32' hinged in the main body 30 and a second shaft like end 32" which is parallel, but brought out of the first shaft like end 32' with the distance E. Thus, the first shaft like end 32' is aligned with the axis X which correspond to the driving axis of crank organ 32, and the second shaft like end 32" is aligned with the driven axis of this crank organ 32 which is coaxial with the axis Xm, while being offset of a distance E with respect to the main axis X.

The male member 10 is hinged on this second crank like end 32", so as this second crank like end 32" is able to revolve about the fixed female axis Xf, i.e. its center Om is able to describe a circle having a radius E and a center Of.

Consequently, the axis Xm of the male member 10 performs an orbital revolution motion about the female axis Xf, which is aligned with the main axis X, whereas the female member 20 rotates on itself about the main axis X of the stationary body 30.

To obtain two dependent degrees of freedom of the male member 10, the crank organ 32 and the female member 20 are able to be in independent motion.

When used as an engine, the rotary screw volume machine transforms the energy coming from the volumetric displacement of a working medium into a mechanical energy, while when it is used as a pump for example, it transforms the mechanical energy of means 31 which further comes from the motion of the crank organ 32 in the volumetric displacement of a working medium. To increase the efficiency of such a volume machine, both crank organ 32 and female member 20 can be performing a rotational motion.

The screw volume machine further comprises a main synchronizing coupling link in the form of crank organ 32 and additional mechanism of synchronization in the form of crank organ 34 parallel to crank organ 32 and gears 36, 38, 40.

The kinematics coupling between the female member 20 and the crank organ 32 provides a revolution of the crank organ 32 on rotating female member 20 driven by transmission one-channel rotational transmission means 31.

However, because the symmetry order Nf is Nm−1, the synchronization is not carried out by self-meshing of the elements, it is necessary to provide a kinematic coupling which can be chosen in the form of reducing or multiplying gear drive.

Consequently, the rotary screw machine comprises a kinematic coupling between the female member 20 and the crank organ 32 to allow the motion of the crank organ 32 on rotation of the female member 20. As represented on FIG. 1, the kinematic coupling can comprise at least one coupling organ 36, such as a toothed wheel, hinged in a pivot link in the body 30, able to engage on one hand with an internal ring gear 38 provided on the female member 20 and on the other hand with a gear 40 provided on the crank organ 32.

The trochoidal machine further comprises an additional crank 34 allowing the circular progressive motion of the male member 10 and the revolution of the male axis Xm about the female axis Xf.

Each crank 32, 34 comprises a first crank like end 32', respectively 34' and a second crank like end 32", respectively 34". The first crank like end 32' cooperates with gear 40, respectively crank like end 34' with the body 30, and the second crank like end 32", respectively 34", is hinged in the male member 10 and which is parallel, but brought out of the first crank like end 32', 34' with the distance E. The male member 10 cooperates with both crank like end 32" and 34", so as male member 10 is able to execute circular progressive motion, i.e. its axis Xm is able to describe a circle having a radius E and a center Of. The eccentricities E of the crank organ 32 and of the crank organ 34 are equal.

The coupling organ 36, 38 and 40, and the crankshaft 34 form the synchronizer, which allow the synchronization of the male swiveling and the female rotation motions.

The transmission ratio between the crank organ 32 and the male member 20 is determined by gear wheels 36, 38 and 40 and in particular by the number of teeth Z38 and Z40 of gears 38 and 40. The angular cycle is performed per 180 angular degrees of rotation of member 20, when $$\frac{Z38}{Z40} = 2.$$

When used as an engine, the screw volume machine of FIG. 1 converts the energy of a working substance into a mechanical energy transmitted to means 31. On the opposite, when the machine is used as a pump for example, it converts the mechanical energy coming from means 31 into a working substance energy.

FIG. 3 illustrates the version of three-dimension rotary screw volume machine with the circular progressive motion of the male member 110, which operates similarly to the machine shown in FIG. 1, but with a different ratio of number of symmetry between the male and the female surfaces. Here, the outer surface 112 of the male member 110 has the form of two-arc trochoid 114 (Nm=2) in a cross-section (see FIG. 4), whereas the inner surface 122 of the female member 120 is in the form of three-arc outer envelope 124 (Nf=3) in a cross-section (see FIG. 4).

Here again, the male member 110 is cooperating with the crank organ 32 and the crank 34 to perform a circular progressive motion, i.e. the axis Xm of the male member 110 is able to perform an orbital revolution motion, whereas the female member 120, hinged in pivot link with in the stationary body 30, is able to rotate on itself.

However, in this case, due to the fact that the number of shape-forming arcs is higher for the female 124 (Nm+1), than for the male surface 122, the female 120 and the male 110 members form a kinematic pair, which provides self-synchronization.

The volume machine of FIG. 3 operates in the following manner.

When swiveling the crank organ 32 (FIG. 3), due to the cooperation with the crank 34, the male member 110 executes the circular progressive motion, the male axis Xm describes a cylinder having a radius E about the female axis Xf, but the male member does not swivel on itself.

As a result of the motion of the male member 110, a self-meshing of the male surface 112 with the inner surface 122 of the female member 120 takes place, thus leading to the rotation, in the same direction as the crank organ 32, of the female member 120 on itself about its axis Xf, which is aligned with the main axis X of the body 30.

FIG. 5 illustrates the version of three-dimension screw volume machine with a circular progressive motion of the male member 110, and FIG. 6 is a cross section on the line VI-VI of FIG. 5, which operates similarly to the machine shown in FIG. 3 (Nm=2 and Nf=3), but with a different connection of the one-channel rotational means 31 and two parallel cranks 34 instead of only one.

On one hand, here again, the male member 110 is cooperating with at least two parallel cranks 34 to perform a circular progressive motion. On the other hand, here there is no crank organ 32 and it is the female member 120 hinged in pivot link in the stationary body 30, which is able to rotate, driven by the one-channel transmission means 31. Each crank 34 comprises a crank like end 34' hinged in the body 30 and a crank like end 34" hinged in male element 110. The cranks 34 are parallel to one another and have the distance E between 34' and 34". The male member 110 cooperates with the two crank like end 34", so to be able to execute a circular progressive motion of male element 110, when axis Xm revolves in a circle having a radius E and a center Of. Here, the eccentricities of cranks 34 are chosen to be equal to E.

The female member 120 being directly driven by the one-channel means 31, there is no need of a specific crank organ 32 as describe in FIG. 3. In fact, here the cranks 34 perform as the crank like mechanism.

The rotary volume machine of FIG. 5 operates in the following manner. When means 31 rotates the female element 120 with the angular speed $\omega_1$ about its axis Xf, which coincides with the main axis X of the body 30, the inner surface 122 of female member 120 interacts with the outer surface 112 of the male element 110, thus leading to the circular progressive motion of male element 110 in the same direction as female 120 on parallel cranks 34. When the male member 110 executes the circular progressive motion, the male axis Xm describes a circle having a radius E and a center Of, with the angular speed $\omega_0$ of a revolution, but the male member 110 is not swiveling ($\omega_2$=0).

In this case, $$\frac{\omega_0}{\omega_1} = 3$$

and $\omega_2$=0 and an angular cycle measured on rotation (element 120) is equal to 180°.

FIG. 7 represents another version of embodiment of a three-dimension rotary screw volume machine with two degrees of freedom of which one is independent. Here as for FIG. 1, the female member 20 is able to perform a circular progressive motion, whereas the male member 10 connected to a one-channel rotational means 31 is able to rotate on itself about its male axis Xm, which is coaxial with the main axis X.

Here again, because the number of shape-forming arcs of the female profile 24 is lower, than those of the male profile 14 (Nf=2 and Nm=3, see FIG. 8), it is necessary to provide kinematic coupling between the male 12 and the female 22 surfaces.

The male member 10 extends on one end with a shaft 42 on which an external ring gear 44 is mechanically fixed. The other end of the male member 10 is hinged in the main body 30 with a pivot link so as to be able to rotate about the main axis X. The external ring gear 44 is continuously meshing with a plurality of gears 46 hinged in the main body 30 in a pivot link, so as to drive these gears 46 in rotational motion on themselves. The number Z44 and Z46 of teeth of gears 44 and 46 is chosen such that $$\frac{Z44}{Z46} = 3.$$

Each gear 46 is provided with a crankshaft 48 which is off-center from the axis 46' of each gear 46 of a length equal to E. The parallel crankshafts 48 are placed in a pivot link in the female member 20.

The elements 42, 44 and 46 have to be compared to the crank organ 32, the gear 30, gears 36 and the internal ring gear 38 of the machine of FIG. 1.

The operation of the volume machine shown in FIG. 7 proceeds with the circular progressive motion of the female member 20. In this machine, when the male member 10 is driven by the rotational means 31, it rotates the gear wheels 44 and 46 and thus revolves the crankshafts 48. Due to the rotation of the crankshafts 48, the axis Xf of the female member 20 performs an orbital revolution motion about the male axis Xm, i.e. the female center Of describes a circle having a radius E and a center Om in the same direction as the male member 10.

In the versions of the machine embodiments aforementioned, the choice of the eccentricity E has no effect on the values of diameters of the synchronizing gear wheels 36, 38, 40 of FIG. 1 and 44, 46 of FIG. 7.

FIG. 9 illustrates a rotary screw volume machine similar to the rotary screw machine of FIG. 1, but with three degrees of freedom, two of them being independent. This rotary screw volume machine comprises the female member 20 of screw shape (two arcs), the three-arcs male member 10 (see FIG. 10), the stationary body 30, the crank like mechanism comprising the crank organ 32 hinged with a pivot link in the main body 30 having the main axis X, so that the axis Xm of the male member 10 is able to revolve about the female axis Xf which is aligned with the main axis X and the female member 20 is able to rotate with rotational means 131 about the main axis X.

Because the symmetry order Nf is Nm−1, the synchronization is not carried out by self-meshing of the elements, it is necessary to provide a kinematics coupling between the male and the female members.

Consequently, the crank organ 32 and the female member 20 can be linked to a two-channel rotational transmission means 131. The female member 20 is connected to one of the two channels of the rotational transmission means, whereas, the crank organ 32 is connected to the other one of the two channels of the rotational transmission means.

Under two-channel connections of means with two independent degrees of freedom of the machine, any two angular rotation velocities of the female member 20 or the crank organ 32 can be specified (independent degrees of freedom), whereas the third swiveling angular rotation velocity of the male member 10 (dependent degree of freedom) is set in the machine as a differential function of the two independent velocities. In this case, additional synchronizing means are not needed.

On the opposite, under one-channel transmission means 31 (see FIG. 11), the coupling with a machine would be performed through one channel of independent degree of freedom, and an additional synchronizing means should be introduced into the machine to connect any two of the three machine elements (male member 10, female member 20 or crank organ 32) with the feasibility to decrease the quantity of independent degrees of freedom of machine by unity.

The additional degree of freedom is the swiveling motion of the female member 20.

For example, as represented on FIG. 9, the male member 10 provides at one end an internal ring gear 50 that engages with a pinion 52 rigidly fixed on the female member 20 and hinged in the main body 30 so as to be able to rotate with means 131. The planetary gear transmission 50 and 52 connects respectively mechanically the male member 10 and the female member 20, whereas both crank organ 32 and female member 20 are connected to a two-channel rotational means 131.

Due to the different gears, when the crank organ 32 rotates in a direction, the male member 10 performs an orbital revolution in a similar direction, i.e. the male axis Xm describes a circle of center Of in the same direction of rotation as the crank organ 32, whereas the male member 10 swivels on itself in the opposite direction of rotation. In fact, the orbital revolution of the male axis Xm and the swiveling motions of the male member 10 are in opposite direction.

To obtain a contra-rotating rotary screw three-dimension volume machine, i.e. the revolution speed of the female member 20 and the orbital revolution speeds of the crank 32 and the male axis Xm are equal, but in an opposite direction, the different gears can for example be chosen as follows. The internal ring gear 50 has an internal radius equal to three times E, 3×E, the outer gear 52 has an external diameter equal to 2×E. Thus, the ratio of the number of teeth Z50 and Z52 of each gear 50 and 52, is chosen so that $$\frac{Z50}{Z52} = \frac{3}{2}.$$

The operation of the contra-rotating rotary screw three-dimension volume machine of FIG. 9 proceeds as follows. With help of rotational means 131, when rotating the crank organ 32 and simultaneous female member 20, on one hand, due to the crank organ 32, the male member axis Xm performs the orbital revolution motion about the main axis X, and on the other hand, due to the interaction of internal ring gear 50 of the male member 10 with external gear 52 connected to the female member 20, the male member 10 execute the swiveling motion on itself. The combination of both motions, swiveling and orbital revolution of the male axis Xm, springs up the planetary motion of the male member 10.

The efficiency of the screw machine being proportional to the speed of the processes of opening and closing the chambers between the conjugated surfaces of male and female members is determined by the duration of the angular cycle of the machine. In this machine represented on FIG. 9, the angular cycle is equal 270 angular degrees, that is twice as less than in the known machines of this type, because it is performed, when two members forming the working chambers are in a relative simultaneous motion.

However, the best result for the machine of FIG. 9 is obtained when the revolution speed of an axis of member 10 is equal to the rotation speed of member 20 and occurs in the opposite direction of rotation. In this case, the mechanical strengths produced by rotating female 20 and by a revolution of crank 32 with male member 10 on the main body 30 are equal and opposite, such that the resultant momentum is practically nil. These kinds of machines are used in cases where the vibrations are to be avoided or greatly limited.

FIG. 11 illustrates a rotary screw volume machine similar to the rotary screw machine of FIG. 9, but with three degrees of freedom, one of them being independent and with one-channel rotational means 31. This rotary screw volume machine comprises the female member 20 of screw shape (two arcs), the three-arcs male member 10 (see FIG. 12), the stationary body 30, the crank like mechanism comprising the crank organ 32 hinged with a pivot link in the main body 30 having the main axis X, so that the axis Xm of the male member 10 is able to revolve about the female axis Xf which is aligned with the main axis X and the female member 20 is able to rotate on itself about the main axis X.

To avoid having the rotational means connected to both crank organ 32 and female member 20 and because the number of shape-forming arcs of the female profile 24 is lower than those of the male profile 22, the rotary screw machine comprises a planetary gear transmission. According the disposition of both gears internal/external engagement, the planetary gear transmission 50, 52, drives the female member 20 in the same direction or in the opposite direction relative to the crank organ motion.

To provide this additional motion, the rotary screw machine comprises an additional synchronizer, which comprises a planetary gear transmission. It is also possible to make the additional synchronizer in the form of a coulisse mechanism with a rotating or fixed coulisse or an inverter of a motion direction.

For example, as represented on FIG. 11, the male member 10 provides at one end an internal ring gear 50 that engages with a pinion 52 rigidly fixed on the female member 20 and hinged in the main body 30.

To synchronize the different motions between the male 10 and female 20 members, the rotary screw machine further comprises a synchronizer. For example, the male member 10 provides at its other end a pinion 54, which engages with an internal ring gear 56, fixed in the main body 30.

Due to the different gears, when the crank organ 32 rotates in a direction, the axis Xm of the male member 10 rotates in a similar direction, i.e. the male axis Xm describes a circle of center Of in the same direction of rotation as the crank organ 32, whereas the male member 10 swivels on itself in the opposite direction of rotation. In fact, the orbital revolution of male axis Xm and the swiveling motions of the male member 10 are in opposite direction.

To obtain a contra-rotating screw three-dimension volume machine, i.e. the rotational speed of the female member 20 and the orbital revolution speed of the male axis Xm are equal but in an opposite direction, the different gears can for example be chosen as follows. The internal ring gear 50 has an internal radius equal to three times E, 3×E, the outer gear 52 has an external radius equal to 2×E. Thus, the ratio of the number of teeth Z50 and Z52 of each gear 50 and 52, is chosen so that $$\frac{Z50}{Z52} = \frac{3}{2}.$$

The internal ring gear 56 has an internal radius equal to 4×E, the outer gear 54 of the male member 10 has an external radius equal to 3×E.

Thus, the ratio of the number of teeth $Z_{56}$ and $Z_{54}$ of each gear 56 and 54 is chosen so that $$\frac{Z56}{Z54} = \frac{4}{3}.$$

The operation of the contra-rotating screw three-dimension volume machine proceeds as follows. When rotating the crank organ 32 (via the one-channel rotational means 31), on one hand, the axis Xm of the male member performs the orbital revolution motion about the main axis X, and on the other hand, the gear 54 of the male member 10 is rolled on the inner surface of the stationary internal ring gear 56 and thus makes the male member 10 execute the swiveling motion on itself. The combination of both motions, swiveling and orbital revolution, springs up the planetary motion of the male member 10. Moreover, the internal ring gear 50 rotates the gear 52 of the female member 20, which rotates contra-rotatively according to the crank organ's direction.

FIG. 13 shows a longitudinal section of a contra-rotating screw volume machine with one independent degree of rotation of the female member 20, in which Nf=Nm−1, and FIG. 14 is a cross section on the line XIV-XIV of FIG. 13, similar to the screw machine of FIG. 11 (Nf=2 and Nm=3), but with a different connection of the one-channel rotational means 31.

The male member 10 is able to execute a planetary motion about the female axis Xf, which coincides with the main axis X and the female member 20 is able to rotate about the main axis X and connected mechanically to one-channel transmission means 31.

The female member 20 has a profile 24 and male member 10 has a profile 14. The screw machine comprises the same planetary gear transmissions 54, 56 as described in FIG. 11, but another planetary gear 150, 152 replace the former planetary gear 50, 52 aforementioned.

According the disposition of both gears internal/external conjugation, the planetary gear transmission 150, 152 has the relation $$\frac{z_{150}}{z_{152}} = \frac{3}{2},$$

where $z_{150}$ and $z_{152}$ represent respectively the number of teeth of gears 150, 152. Accordingly, herewith, gear 152 (outer conjugation) is disposed on female member 20 and connected to the one-channel means 31 and gear 150 (inner conjugation) is disposed on male member 10.

The independent degree of freedom is the rotation of the female member 20, and the dependent degrees are the motion of male member 10 (swiveling of its member and revolution of its axis Xm). To create these two dependent motions, the machine comprises the additional synchronizer comprising the planetary gear transmission 54, 56 aforementioned. For example, the planetary gear transmission 54, 56 has the relation $$\frac{z_{56}}{z_{54}} = \frac{4}{3},$$

where $Z_{56}$ and $Z_{54}$ represent respectively the number of teeth of gears 56, 54.

Due to said gears, the axis Xm of male member 10 performs a revolution in opposite direction of the swiveling of the male member 10 about its male axis Xm and describes a circle having a radius E and a center Of. The female member 20 executes a rotation about fixed axis Xf in opposite direction of the revolution of the male axis Xm.

The speed of the female member 20 and the rotation speed of the male axis Xm are equal, but have opposite direction. The different gears can for example be chosen as follows. The internal ring gear 150 has an internal radius equal to 3×E (three times E), the outer gear 152 has an external radius equal to 2×E. The internal ring gear 56 has an internal radius equal to 4×E, the outer gear 54 of the male member 10 has an external radius equal to 3×E.

The operation of the screw three-dimension volume machine proceeds as follows. When the female member 20 and the gear 152 rotate, due to their connection to the one-channel rotational means 31, the male member 10 and the gears 150 and 54 execute a planetary motion about the main axis Xf. As the gear 54 of the male member 10 is rolled on the inner surface of the stationary internal ring gear 56, the male member 10 execute a swiveling about its axis Xm and its axis Xm executes a revolution about axis X. Moreover, the internal ring gear 152 rotates the gear 150 of the male member 10, creating a revolution of its axis Xm at an angular velocity equal to velocity of female element 20, but in opposite direction.

The angular cycle of the machine described on this FIG. 13 is equal 270° of an angular turn of the female element 20.

FIG. 15 shows a longitudinal section of another version of embodiment of a rotary screw of three-dimension volume contra-rotating machine with three degrees of freedom and two-channel rotational means 131. In fact, this machine has to be compared to the abovementioned machine (FIG. 9) in which the male member 110 is performing a planetary motion and the female member 120 is rotating on itself, but now the male member 110 has a nominal profile 114 composed of two arcs and the female member 120 has a nominal profile 124 composed of three arcs (see FIG. 16).

In this case, due to the fact that the number of shape-forming arcs is higher for the female profile 124 (Nf=Nm+1), than for the male profile 114, the female 120 and the male 110 members form a kinematics pair which provides self-synchronization and synchronizing coupling between the female 120 and the male 110 members, such as the kinematics coupling of gear wheels 50 and 52 of FIG. 9, is not needed.

Two outlets of the two-channel transmission means 131 are respectively and mechanically connected to female member 120 and crank 32 to create a rotation (first independent velocity) of female member 20 about its fixed axis Xf and a revolution (second independent velocity) of male axis Xm about the main axis X so as to define a contra-rotating machine having a resultant momentum almost nil.

This machine operates similarly to the machine shown in FIG. 9. The male member 110 is hinged on crank 32 and performs a swiveling about its axis Xm when the crank organ 32 rotates, and the female member 120 hinged in body 30 is able to rotate about the main axis X.

The two-channel rotational means 131 creates the two independent velocities of a rotation for female member 120 and a revolution for crank organ 32, which are equal to one another but have opposite direction.

Thus, when crank 32 revolves, the male member 110 executes a planetary motion in the process of which due to the self-synchronization male profile 114 interacts with the female profile 124, then male member 110 swivels (third dependent velocity) about movable axis Xm. The male member 110 swivels in the same direction as the female member 120. The angular cycle of the machine of FIG. 15 is equal 180 degrees of an angular turn of the female member 120 or the crank organ 32.

In the machines described on FIGS. 9 and 15, there are three degrees of freedom of which the two ones are independent and the transmission of positive energy of conversion is performed by the two-channel means 131 through two mechanical channels of independent rotation or revolution.

Any two angular speeds of motions of said three ones (rotation, revolution or swiveling of male or female member, or synchronizing coupling link) can be specified as independent of one another. The initial phase and direction of each rotation are defined, and the values of said angular speeds are chosen in conformity with the equations:

$$k_1\omega_1+k_2\omega_2+\omega_3=0,$$

where: $\omega_1,\omega_2$ represent the angular speed of the said conjugated members about their axis;

$\omega_3$ represents the angular speed of the link of synchronizing coupling;

$k_1,k_2$ represents the constant coupling coefficients. Herewith, the values of angular velocities of rotation of conjugated members are defined from relation:

$$(z-1)\omega_1-z\omega_2+\omega_0=0,$$

where:

$\omega_1$ is the angular speed of member around its axis, enveloping surface of which has the form of curvilinear surface;

$\omega_2$ is the angular speed of rotation of member around its axis, enveloping surface of which has a shape of inner or outer envelope of a family of surfaces, formed with the said curvilinear surface;

$\omega_0$ is the angular speed of the orbital revolution of the axis of the member, executing planetary motion;

z is an integer, z>1.

FIG. 17 shows a longitudinal section of another version of embodiment of a rotary screw of three-dimension volume contra-rotating machine with three degrees of freedom and one-channel rotational means 31. In fact, this machine has to be compared to the abovementioned machine of FIG. 11 in which the male member 10 executes a planetary motion and the female member 20 rotates on itself, but now the male member 110 has a nominal profile 114 composed of two arcs and the female member 120 has a nominal profile 124 composed of three arcs (see FIG. 18).

An inverter 58 can be placed between the female member 120 and the crank organ 32 to invert the motion direction between the rotational motion of the female member 20 on itself and the orbital revolution motion of the male axis Xm about the main axis X so as to define a contra-rotating machine having a resultant momentum almost nil.

This machine operates similarly to the machine shown in FIG. 11. The male member 110 cooperates with the crank organ 32 and performs a planetary motion about the main axis X, and the female member 120 is hinged in the body 30 and is able to rotate on itself about the main axis X. The female member 120, through the direction motion inverter 58 is mechanically connected with the crank organ 32. The inverter 58 leads to the same speed for the female member 120 and for the crank organ 32, i.e. for the orbital revolution of the male axis Xm, but the two motions occur in opposite direction.

When rotating the crank organ 32 (via the one-channel rotational means 31), the male member 110 executes the planetary motion; due to the self-synchronization taking place when the male profile 114 interacts with the female profile 124, the female member swivels on itself. The rotation of crank organ 32 through the inverter 58 causes the rotation of the female member 120 at the same angular speed as the rotation speed of this crank organ 32, but in the opposite direction. The male member 110 swivels in the same direction as the female member 120 rotates.

FIG. 19 illustrates the version of a three-dimension rotary screw volume machine with a planetary motion of the male member 110, which operates similarly to the machine shown in FIG. 9, but with a different ratio of velocities. In FIG. 19, there is one independent degree of freedom, i.e. the rotation of the female member 120. The swiveling and the revolution of male member 110 are dependent motions. The angular speed of a swiveling of male member 110 is equal to −3 arbitrary units, and the angular speed of a revolution of its axis Xm is equal to +3 arbitrary units, i.e. they are equal in values but opposite in direction. The angular speed of rotation of female member 120 about its fixed axis Xf is equal to −1 arbitrary units. Here, the outer surface 112 of the male member 110 has the form of two-arc trochoid (Nm=2) in a cross-section, whereas the inner surface 122 of the female member 120 is in the form of three-arc outer envelope (Nf=Nm+1=3).

Here again, the male member 110 is mechanically rigidly connected to a crank organ 59, the main crank 59" of which is mechanically rigidly connected to male member 110 in a point 62. The point 62 has the coordinates (0; E), when the male center Om is taken as an initial position of coordinate system. A crankpin 59' of the crank organ 59 extend at 2E distance from the main crank 59" and is disposed along the female axis Xf.

Two sliders 60 are hinged on the main crank 59" and on the crankpin 59', with the possibility to slide in rectilinear grooves, e.g. in two coulisses 61 provided in the fixed body 30. The longitudinal axes of these coulisses 61 are perpendicular.

Taken in combination, the crank organ 59, the sliders 60 and the coulisses 61, form an ultimate coulisse mechanism intended for creating a planetary motion of the crank organ 59 together with the male member 110 relative to the body 30 about the female fixed axis Xf. The female member 120 is hinged in the body 30 and is mechanically connected to a one-channel transmission means 31 and is able thus to rotate by this means about its fixed axis Xf.

However, in this case, due to the fact that the number of shape-forming arcs is higher for the female 122, than for the male surface 112 (Nf=Nm+1), the female member 120 and the male member 110 form a kinematics pair with self-synchronization only with availability of the coulisse mechanism 59, 60, 61 providing a planetary motion of male member 110.

The rotary volume screw machine of FIG. 19 operates in the following manner. When the one-channel rotational means 31 rotates the female member 120 about its fixed axis Xf, then due to the cooperation of curvilinear surfaces 122 and 112, and cooperation of the crank organ 59, the sliders 60 and the coulisses 61, the male member 110 executes the planetary motion, i.e. the male axis Xm revolves in a circle having a radius E and a center Of, the sliders 60 execute a reciprocating motion with an amplitude 4E in the coulisses 61. As a result of the swiveling and revolution of the male member 110 with the same velocities, a self-meshing of the male surface 112 with the inner surface 122 of the female member 120 takes place, thus leading to the same direction of swiveling of the male member 110 about its movable axis Xm and rotation of female member 120 about its fixed axis Xf, which coincides with the main axis X of the body 30.

An angular cycle of machine of FIG. 19 is equal to 90 angular degrees of turn of female member 120.

To increase the efficiency of such kind of three-dimension rotary screw volume machine, it is also possible to increase the number of male and female members, which can be coupled to one another mechanically or through the working medium. The additional male and female members can be disposed in line with said male and female members or can be disposed coaxially inside said male and female members as illustrated in FIG. 20, in such a way that their surfaces are in mechanical contact so as to form additional chambers.

Referring to the FIG. 20, in which for example, four members 500, 600, 700 and 800 engage in each other. A first two-arc member 500 (male) is engaging in the inner three-arc profile 624 (outer envelope of a family) of a first three-arc member 600. This first three-arc member 600 is a female member for the first two-arc member 500, but is a male member for the second two-arc member 700 in the inner profile 724 of which the outer profile 614 (inner envelope of a family) of this first female member 600 is engaging. It occurs the same with this second two-arc member 700, which is also male and female, and which outer profile's 714 (two-arc initial trochoid) is engaging in the inner three-arc profile 824 (outer envelope of a family) of a last three-arc member 800. In this particularly case, the member 700 can be mechanically connected to the member 500, and the member 600 to the member 800, and the number of working chambers 11, has increased from three to nine.

The three-dimension rotary screw volume machine can comprises at least one additional male and female members disposed in line (not illustrated) and mechanically rigidly connected to said main male and female members herewith forming additional working chambers.

Moreover, all the three-dimension rotary screw volume machines above described can have male and female surfaces degenerated into cylindrical surfaces.

We will now explain how the medium is displacing in the working chambers of such a three-dimension rotary screw volume machine.

The interconnected rotary motion of a link of synchronizing coupling and, at least, two sets of enclosing and being enclosed conjugated elements is executed. In the initial state, the elements of sets turn about their common fixed axis relative to each other; with the feasibility to form set of volumes between the male and female members, that jointly form the total working chambers. These volumes are limited by the surfaces made in the shape of cycloid or trochoid, or in the shape of fragments of said surfaces, which taken jointly form the total working (displacing) chambers.

Two motions of said three ones (swiveling and orbital revolution of the male member, and rotation of the female member) are independent of one another.

For example, referring to FIG. 21, seven elements **10*n* fixed together so as to form the three arcs male member 10 of FIG. 11 with vertices $A_1$, $A_2$, $A_3$, and the male profile 12 is made in the form of the outer surface (Nm=3). Seven elements 20***n* form also together the female member 20, which defines the inner surface. Each element of female member 20 has a cross section, which is limited radially by a cylindrical surface having an order of symmetry Nf about the female axis Xf (e.g. in the shape of two-arc epitrochoid, Nf=Nm−1=2). The number of intersecting points of the inner and outer surfaces z is equal to three (z=3). The axes Xm and Xf are spaced apart by a distance E (eccentricity).

FIG. 21 illustrates also, in a diagram, the seven angular positions a, b, c, d, e, f and g of the seven elements composing each member male 10 or female 20 according to the length L of the machine. The male and female elements are turned around their axis, respectively Xm and Xf, in one direction. The period Pm represented by b-f, on which the total working chamber is made, i.e. at mentioned section a period of total variation of an area of the end section of the working chamber is performed, i.e. it corresponds to a complete opening and closure of a working chamber.

The ratio of periods of birotative turn of male and female elements of conjugated sets is equal to Nm/Nf=3/2. The male and female elements form the three total working chambers and define three areas $S_{A1A2}$, $S_{A2A3}$, $S_{A3A1}$ of end sections of which vary with a spatial shift Pm/3.

The ratio of turn angles of the elements on the period b-f of turn, or the axial period of total volumes, is chosen proportionally with the ratio of the orders of symmetry of shape-forming arcs of the profiles 14 and 24, so that at z turns of female member 20 (trochoid), there would be z−1 turns of the male member 10 (internal envelope), with feasibility to form the total displacing working chambers with the closed areas $S_{A1A2}$, $S_{A2A3}$, $S_{A3A1}$ taken in a cross section.

In position b, taken as an initial position, closed area $S_{A2A3}$ has a minimal value. In position c, the elements 10*n* of the male member 10, are turned about their male axis Xm in clockwise direction through an angle ($\phi_m$=90°, and the elements 20*n* of the female member 20 are turned around Xf axis through an angle of $\phi_f$=135°. The ratio of turn angles $\phi_f/\phi_m$ is equal to 3/2.

In position d the turn angles, relative to initial position b are equal 180° for the male member 10 and 270° for the female member 20, etc. For example, the closed area $S_{A2A3}$ has a maximal value in position d.

When the male member 10 and the female member 20 execute the aforesaid turns, all elements of male and female members taken in combination at each turn and in relation with their specific thickness and position side by side, form the total working chambers with a discreet step three-dimensional change of the volumes and with the feasibility of axial motion of the volumes of working chambers.

In increasing the number of elements up to infinity and decreasing their axial thickness up to zero defining curvilinear conjugated surfaces, the three-dimension changes along the axis of the volumes of total working chambers between the male 10 and the female 20 appear smoothly.

According to the number of elements, the number of arcs and the speed and direction of rotation motion, the axial period of total volumes will differ.

The conjugated pair of male 10*n* and female 20*n* elements is self-sufficient. The process of an axial motion from chamber to chamber, carries out different thermodynamic transformations (compression, expansion and so on) of different working media, that is why the process of axial motion of the volumes from one working chamber 11 to another one can be done without using end walls, additional bodies, elements for gas distribution, valves, etc.

In FIG. 21, there are three of such volumes and the spatial phase shift between them is equal to 120°. The scheme of FIG. 22, explains the method of transforming the motion in rotary screw volume machine in which the male member 10 is in planetary motion in a female member 20, which is rotating about the main axis of the machine.

The male member 10 having an Nm order of symmetry revolves, i.e. its axis Xm describes a portion cylinder having a radius equal to E and at an angular speed $\omega_0$=+ω through an angle θ about the female axis Xf. Moreover, at fixed female member 20, the male member 10 swivels on itself at an angular speed +ω/3 about its axis Xm in the same direction as its orbital revolution motion, so that the three vertices $A_1$, $A_2$ and $A_3$ slide on the epitrochoid profile 24 of the female member 20 in continuous contact with it. The inner surface of the female member 20 is limited radially by a cylindrical surface having an order of symmetry Nm−1 (e.g. two-arc epitrochoid).

In a planetary motion of the male member 10, whereas the female member 20 is stationary, the working volumes considered in a cross section describe a circle and the total working volumes execute axial motion along the longitudinal axes of the elements.

In the initial position, the male member 10 has a period b-f (Pm) of a screw turn about the male axis Xm, and the female member 20 has a period Pm=3/2 Pm about axis Xf. In FIG. 21, the period b-f is equal to a period of a complete opening and closure of a working chamber. When the female member 20 is fixed, an angular speed of a revolution of the male member axis Xm is equal to $\omega_0$=ω, and the angular speed of a swiveling of the male member 10 about its movable axis Xm is equal to $$\omega_2 = \frac{\omega_0}{3} = \frac{\omega}{3}.$$

According to the invention, as the independent motions any two of the three motions of male and female members and synchronizing coupling link can be determined, we determine a counter-rotative revolution of axis Xm of the male member 10 (carried out by crank mechanism which is not shown in FIG. 21) at $\omega_0$=+ω and additional rotation of the female member 20 about fixed axis Xf at $\omega_1$=−ω, i.e. revolution of the crank mechanism about axis Xf and an axis Xm of the male member 10 at +ω is performed simultaneously.

The dependent angular speed $\omega_2$ is swiveling of the male member 10 about movable axis Xm and is determined by the equation mentioned above (at z=3): $(3-1)(-\omega)-3\omega_2+\omega=0$. Whence:

$$\omega_2 = -\frac{\omega}{3}.$$

An angular cycle of the axial movement of one closed volume between the male and female members in the planetary method of transforming a motion at fixed female member 20 is performed per 540° of a revolution of male axis Xm about the axis Xf of the female member 20.

According to the invention an angular cycle measured on rotation (element 20) or on revolution (crank) is θ=270°, and the angular cycle measured on swiveling (element 10) is $$\Psi = \frac{\theta}{Nm} = 90°.$$

We have seen that the additional independent degree of freedom of rotational motion of the female elements is brought when three rotary motions are made, two of them are independently chosen. The initial phase and direction of each rotation are defined, and the values of rotation angular speeds of said sets of conjugated elements are chosen in conformity with the equations:

$$\begin{cases} K_1\omega_1 + K_2\omega_2 + \omega_3 = 0 \\ (z-1)\omega_1 - z\omega_2 + \omega_0 = 0 \end{cases}$$

where $\omega_1$, $\omega_2$ are the rotational speeds of said male and female members on themselves about their axis;

$\omega_3$ is the rotational speed of the synchronizing coupling link;

$K_1$, $K_2$ are constant coupling coefficients, $\omega_0$ is the angular speed of revolution motion of the male axis Xm rotating about the female axis Xf;

z is the number of cross points $A_1$, $A_2$, $A_3$, etc. of inner and outer envelopes of said male and female surfaces, and can be any integer which is more than unity.

Any two of the angular independent speeds can be chosen in an arbitrary way, coefficients and the third dependent speed are determined by the equations given above.

After specifying the values of the two independent speeds and z value, they should be substituted into the equations mentioned above, so as to obtain the values of the dependent speed and the constant coefficients.

To create an additional independent degree of freedom of rotary motion of the conjugated elements an additionally birotative motion of both members is introduced. As shown in FIG. 22, the male member 10 and the female member 20 rotate additionally about their centers Om and Of in one direction (opposite to a revolution of an axis of the male member) with the angular speeds $-\frac{2}{3}\omega$ for the male member 10 and $\omega_1=-\omega$ for the female member 20.

In this case, the male member 10 acquires the overall speed of its own peripheral swiveling about its center Om, which is equal to $$\omega_2 = \frac{\omega}{3} - \frac{2}{3}\omega = -\frac{\omega}{3} \text{ and the angle of turn } \Psi = -\frac{\theta}{Nm}$$

about Of (an angle Ψ in FIG. 22 denotes a peripheral turn or swiveling about an axis Xm crossing the male center Om, and angle θ denotes a turn angle of the female member 20 about fixed axis Xf crossing the female center Of). The center of male element Om retains its orbital motion speed in a circle $\omega_0=+\omega$ and an angle θ, and the female member 20 is imparted the speed $\omega_2=-\omega$. This indicates that in this case the vertices $A_1$, $A_2$, $A_3$ of the three-angular male member will describe a hypotrochoid and at the same time will slide along a female member epitrochoid which rotates about its center Of with an angular speed $-\omega$.

Other versions of transforming a motion with other combinations of rotary, planetary and circular progressive motions are possible. For contra-rotary variant, we determine $\omega_0=+1$, $\omega_1=-1$, and male member with z=3 inner envelope. Consequently, the substitution of these values in the equations mentioned, gives $k=-1$, $\omega_2=-\frac{1}{3}$.

As it is shown in FIG. 22, an angular cycle decreases to −270° of a turn angle of the female member about its axis Xf. It points to the fact that the angular duration of the cycle decreases by an half in comparison with the known closest analogue of the planetary method of transforming a motion with the stationary epitrochoid of the female member and the male member with three vertices, thus the number of cycles performed per given number of revolutions increases two times, this gives rise to intensification of the thermodynamic cycles of the volume machines as well.

Furthermore, an axis of male member 10 and the female member 20, as it is shown in FIG. 22, rotating in the opposite directions with the equal angular speeds, i.e. counter-rotatively, provide decreasing considerably (up to zero) the combined moment of momentum and reaction moment on the supports of the machine.

The planetary motion of male member 10 can be described by the expression:

$$\bar{e}_{RV} + \frac{1}{z}\bar{e}_S,$$

where $\bar{e}_{RV}$ and $\bar{e}_S$ are unit vectors of the revolution and swiveling speeds of male element.

The birotation of the male and female elements is described by the following expression:

$$k\bar{e}_{R0} + \frac{k(z-1)}{z}\bar{e}_S$$

where $\bar{e}_{R0}$ is a unit vector of the rotation angular speed rotation of the female element 20.

By adding the birotative motion and the planetary motion, we obtain:

$$k\bar{e}_{R0} + \frac{[k(z-1)+1]}{z}\bar{e}_S + \bar{e}_{RV}.$$

From the preceding equations, it follows that on executing the profile of the end sections of the member executing the planetary motion in the form of the inner or the outer envelope of a family of curves and the profile of the member rotating about its fixed axis in the form of the initial curve, the relation of the angular speed of rotation of the latter one to the angular speed of a revolution of an axis of the element executing the planetary motion is equal to k, and the relation of the angular speed of the swiveling motion of the planetary member to the angular speed of a revolution of its axis is equal to $$\frac{[k(z-1)+1]}{z}.$$

So, as an example, with z=3, the planetary motion of the male member with an inner envelope and an additional rotation of epitrochoid of the female member and the male member around their axis, we obtain:

1) $\theta=45°$, $k=-5$, $k_1=-5$ and $k_2=-3$ and an angular cycle equal to $\gamma=90°$ of a revolution of the male member axis about the female center Of.

2) $\theta=135°$, $k=-1$, $k_1=-1$ and $k_2=-⅓$ and an angular cycle equal to $\gamma=90°$ of a swiveling of the male member about its male center Om.

The following versions of transforming a motion in this mechanism are possible:

1) without transmission of motion between the female and the male members; in this case, their motions are defined by the links of synchronization without kinematics interaction of conjugated elements;

2) with the transmission of rotation by interacting conjugated members; in this case, the curvilinear surfaces of female and male members are brought in mechanical contact, forming a kinematics pair and performing with said pair the transmission of motion between female and male members.

A kinematics conjugation of any number of the additional female and male members is possible, which are fitted in the additional means of synchronization with the feasibility of the rotary and planetary motions, herewith the main and additional elements can be placed alongside each other or in the cavities of each other.

The invention claimed is:

1. A rotary screw machine of volume type comprising:

a body having a main axis X;

two members further comprising:

a male member; and a female member surrounding said male member, wherein an outer surface of the male member defines a male surface and an inner surface of the female member defines a female surface, said male and female surfaces being helical surfaces having respective axes Xm and Xf that are parallel and spaced apart by a length E, said male and female surfaces defining at least one working chamber by formation of linear contacts of said male and female surfaces and relative displacement of said male and female members, said male and female surfaces being further defined about said axes Xm and Xf, respectively, by a nominal profile in a cross section of the mechanism, said profile of the male surface defining a male profile having an order of symmetry Nm with respect to a center Om located on said male axis Xm, said profile of the female surface defining a female profile having an order of symmetry Nf with respect to a center Of located on said female axis Xf, said rotary screw machine further having a main synchronizing coupling comprising a crank like mechanism generating an eccentricity defined by said length E between said main axis X and one of the axes (Xm, Xf), in that a first one of said male member and said female member is hinged in said body and is able to rotate on itself about its fixed axis (Xm; Xf) according to a rotational motion, in that the crank like mechanism (32) further comprises:

a first shaft like end (32'); and a second shaft like end (32") hinged in the body (30) parallel to the first shaft like end (32') with said length E between the first shaft like end and the second shaft like end, in that said crank like mechanism is connected to the other of said male member or said female member not hinged in said body to allow the axis (Xf; Xm) of said other of said male member or said female member to revolve about the fixed axis (Xm; Xf) of said first one of said male member and said female member according to an orbital revolution motion having said length E as a radius, and in that said rotary screw machine comprises a main synchronizer synchronizing said swiveling motion and said orbital revolution motion, one with respect to the other, so that said male and female mesh together.

2. A rotary screw machine of claim 1, further comprising:

rotational transmission means connected to said crank like mechanism or to said first one of said male member and said female member.

3. A rotary screw machine according to claim 2, characterized in that said rotational transmission means (131) is a two-channel rotational means (131).

4. A rotary screw machine of claim 1, wherein said male and female surfaces are brought in mechanical contact forming a kinematic pair allowing the transmission of motion between said male and female members.

5. A rotary screw machine of claim 1, further comprising:

an additional synchronizer, linked to said body and allowing said other one of said male member or said female member to rotate about its axis.

6. A rotary screw machine of claim 5, wherein said additional synchronizer comprises a planetary gear transmission.

7. A rotary screw machine of claim 5, further comprising:

rotational transmission means connected to said crank like mechanism and to one of said male or female member.

8. A rotary screw machine according to claim 1, characterized in that said synchroniser further comprises a kinematical coupling mechanism (40, 36, 38; 44, 46, 48) of both members (10; 500; 600; 700; 20; 600; 700; 800) together, said kinematical coupling comprising at least one of said crank like mechanism (36; 46), which is hinged in said body (30).

9. A rotary screw machine according to claim 8, characterized in that said kinematical coupling mechanism comprises a gear transmission (40, 36, 38; 44, 46, 48).

10. A rotary screw machine according to claim 1, characterized in that said synchronizer comprises a planetary gear transmission (54, 56).

11. A rotary screw machine according to claim 1, characterized in that said synchronizer comprises an inverter (58).

12. A rotary screw machine according to claim 1, characterized in that it further comprises at least one additional male and female members (500; 600; 700; 600; 700; 800) disposed in line with said male and female members.

13. A rotary screw machine according to claim 1, characterized in that it further comprises at least a third member disposed inside or surrounding said male and female members (500; 600; 700; 600; 700; 800), in such a way that their surfaces are in mechanical contact so as to form additional chambers (11).

14. A rotary screw machine claim 1, wherein said female order of symmetry Nf is equal to Nm−1.

15. A rotary screw machine according to claim 1, characterized in that said female order of symmetry Nf is equal to Nm+1.

16. A rotary screw machine of claim 1, wherein said male or said female surfaces can degenerate into cylindrical surfaces.

* * * * *